US006971738B2

(12) United States Patent
Sugahara

(10) Patent No.: US 6,971,738 B2
(45) Date of Patent: Dec. 6, 2005

(54) PIEZOELECTRIC ACTUATOR

(75) Inventor: Hiroto Sugahara, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/310,750

(22) Filed: Dec. 5, 2002

(65) Prior Publication Data

US 2003/0107622 A1 Jun. 12, 2003

(30) Foreign Application Priority Data

Dec. 6, 2001 (JP) ..... P2001-372104
May 8, 2002 (JP) ..... P2002-132195
Sep. 27, 2002 (JP) ..... P2002-284304

(51) Int. Cl.[7] ..... B41J 2/045

(52) U.S. Cl. ..... 347/71

(58) Field of Search ..... 347/68–72; 310/365, 310/366

(56) References Cited

U.S. PATENT DOCUMENTS 4,825,227 A * 4/1989 Fischbeck et al. ..... 347/69
5,402,159 A 3/1995 Takahashi et al.
5,594,292 A 1/1997 Takeuchi et al.
6,575,565 B1 * 6/2003 Isono et al. ..... 347/71

* cited by examiner

*Primary Examiner*—Stephen Meier
*Assistant Examiner*—An H. Do
(74) *Attorney, Agent, or Firm*—Reed Smith LLP

(57) ABSTRACT

A first portion F is positioned above the center of the pressure chamber 16. A pair of second portions S are disposed on either side of the first portion F. The electrodes 24, 25 are positioned in the second portion S to the side farthest in the thickness direction from the pressure chamber 16. When voltage is developed between the electrodes 24, 25, the polarized active portions 40 of the piezoelectric sheets 54–56 that are sandwiched between the electrodes 24, 25 contract in the planar direction, so that the second portion S arches downward. As a result, the first portion F is pushed upward and protrudingly arches upward so that the volume of the pressure chamber 16 increases.

52 Claims, 31 Drawing Sheets

PIEZOELECTRIC ACTUATOR

BACKGROUND OF THE INVENTION

1. Field of the Invention

The present invention relates to a piezoelectric actuator and to a fluid transporting device such as an ink jet head that uses the piezoelectric actuator.

2. Description of Related Art

One example of a conventional fluid transporting device is an ink jet head used in an ink jet printer. Ink jet heads use a piezoelectric actuator to eject liquid ink U.S. Pat. No. 5,402,159 discloses an ink jet head 200 of a type shown in FIG. 1.

As shown in FIG. 1, the ink jet head 200 includes a piezoelectric actuator plate 250 and a fluid accommodating plate formed with pressure chambers 216*a*, 216*b*. The piezoelectric actuator plate 250 is a plate-shaped member that covers each of the pressure chambers 216. The piezoelectric actuator plate 250 is made from layers of piezoelectric material 251 to 256 stacked on top of each other. Electrodes 224, 225 are positioned above the center of the pressure chamber 216. Of these, drive-voltage electrodes 224 are disposed on the piezoelectric layers 251, 253 and ground electrodes 225 are disposed on the piezoelectric layers 252, 254. In other words, the piezoelectric layers 251, 253 with the drive-voltage electrodes 224 and the piezoelectric layers 252, 254 with the ground electrodes 225 are stacked in alternation. The other piezoelectric layers 255, 256 are not formed with electrodes and are stacked on top of the piezoelectric layers 251–254 that have electrodes. Portions of the piezoelectric layers 252 to 254 that are in between the electrodes 224, 225 are polarized in a direction perpendicular to the confronting surfaces of the electrodes 224, 225.

By stacking the piezoelectric layers 252–254 and the electrodes 224, 225 in this way, a strong electric field can be developed in the piezoelectric layers 252–254 by applying voltage to the drive-voltage electrodes 224. When the electric field is developed, the portion of the piezoelectric layers 252, 253, 254 in between the electrodes 224, 225 functions as an active portion 240 that extends in the direction in which the layers are stacked. When voltage is applied to the electrodes 224, 225 that correspond to one pressure chamber 216*a* of the piezoelectric actuator plate 250, an electric field that is parallel to the polarization direction is generated in the active portion 240. The active portion 240 extends in the direction in which the layers are stacked so that pressure is applied to the ink in the pressure chamber 216*a* for ejecting ink droplets.

SUMMARY OF THE INVENTION

A large surface area of the piezoelectric layers 252–254 is disposed between the electrodes 224, 225 because the electrodes 224, 225 are formed to substantially match the shape of the pressure chamber 216 as viewed in plan and because the electrodes 224, 225 are stacked on top of each other as described above. Having the broad surface area of piezoelectric material between the electrodes 224, 225, the piezoelectric actuator 250 has a large capacitance. A large electric current is required in order to rapidly drive the piezoelectric actuator 250. This gives the piezoelectric actuator 250 poor energy efficiency.

It is an objective of the present invention to overcome the above-described problems and to provide a piezoelectric actuator, a fluid transporting device, and an ink jet head that have high energy efficiency and that can sufficiently deform the piezoelectric plate.

In order to attain the above and other objects, the present invention provides a piezoelectric actuator comprising: a plate including: first and second surfaces that are separated from each other by a predetermined distance in a thickness direction and that extend in a predetermined planar direction substantially perpendicular to the thickness direction; and an operation portion having: a first portion; and a pair of second portions disposed symmetrically on either side of the first portion with respect to the planar direction; and at least one electrode located in each second portion, an active portion, defined in each second portion by the electrode, being located nearer to the first surface than the second surface in the thickness direction, at least the active portion in the plate being formed from piezoelectric material, the electrode generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction.

According to another aspect, the present invention provides a fluid transporting device, comprising: a plate including: first and second surfaces that are separated from each other by a predetermined distance in a thickness direction and that extend in a predetermined planar direction substantially perpendicular to the thickness direction; and an operation portion having: a first portion; and a pair of second portions disposed symmetrically on either side of the first portion with respect to the planar direction; at least one electrode located in each second portion, an active portion, defined in each second portion by the electrode, being located nearer to the first surface than the second surface in the thickness direction, at least the active portion in the plate being formed from piezoelectric material, the electrode generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction; a fluid accommodating plate disposed so as to face one of the first surface and the second surface of the plate, the fluid accommodating plate being formed with a fluid accommodating chamber, the operation portion of the plate confronting the fluid accommodating chamber, volume of the fluid accommodation chamber changing in association with the deformation of the first portion and of the pair of second portions to transport fluid of the fluid accommodation chamber; and a hole-defining portion defining an ejection hole in fluid communication with the fluid accommodation chamber, change in volume of the fluid accommodation chamber transporting the fluid in the fluid accommodation chamber through the ejection hole.

According to a further aspect, the present invention provides an ink transporting device, comprising: a plate including: first and second surfaces that are separated from each other by a predetermined distance in a thickness direction and that extend in a predetermined planar direction substantially perpendicular to the thickness direction; and an operation portion having: a first portion; and a pair of second portions disposed symmetrically on either side of the first portion with respect to the planar direction; at least one electrode located in each second portion, an active portion, defined in each second portion by the electrode, being located nearer to the first surface than the second surface in the thickness direction, at least the active portion in the plate being formed from piezoelectric material, the electrode generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction; an ink accommodating plate disposed so as to face one of the first surface and the second surface of the plate, the ink accommodating plate being formed with an ink accommodating chamber, the operation portion of the plate confronting the ink accommodating chamber, volume of the ink accommodation chamber changing in association with the deformation of the first portion and of the pair of second portions to transport ink of the ink accommodation chamber; and a hole-defining portion defining an ejection hole in ink communication with the ink accommodation chamber, change in volume of the ink accommodation chamber transporting the ink in the ink accommodation chamber through the ejection hole.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
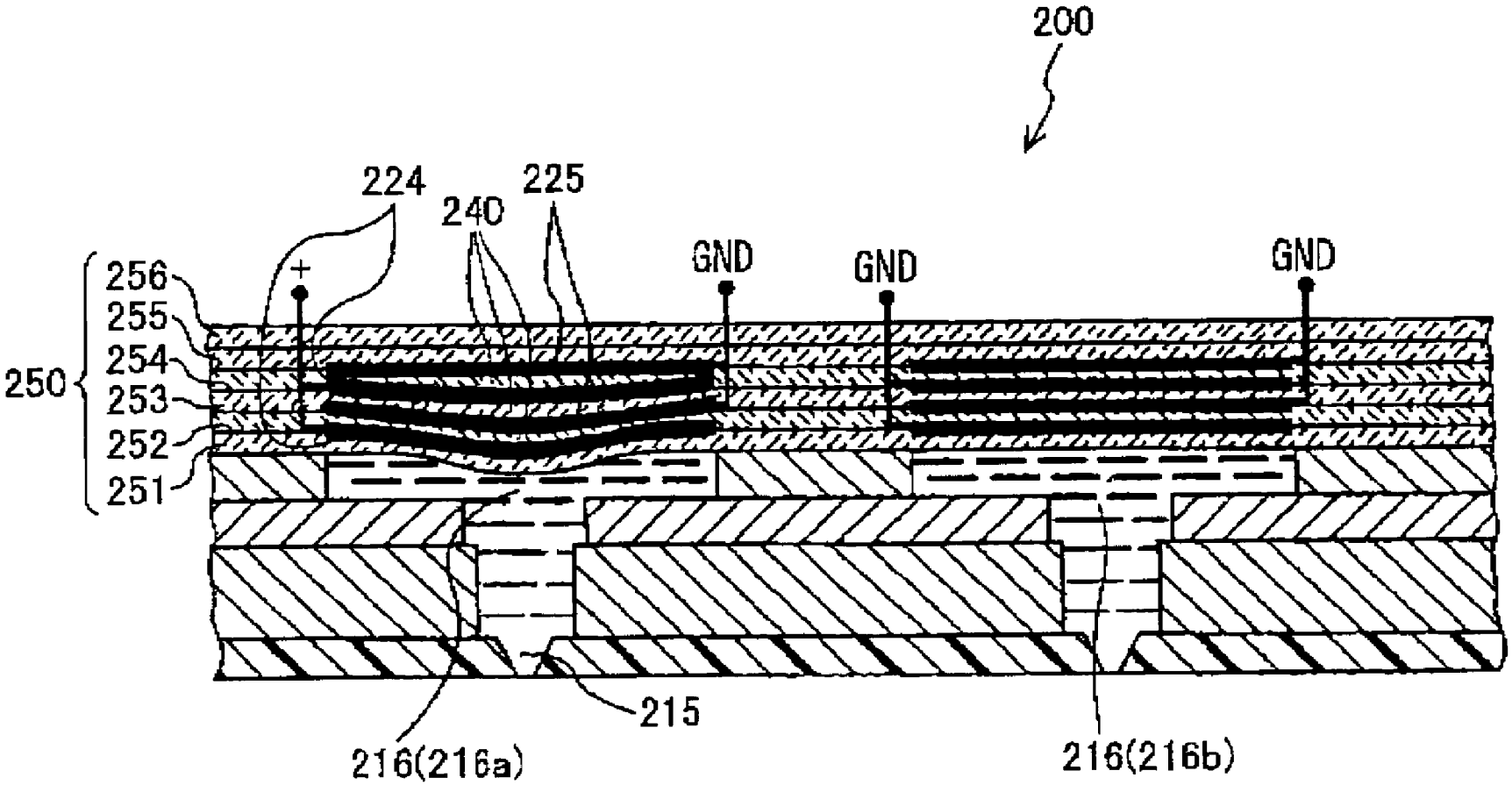
FIG. 1 is a partial cross-sectional view of a conventional ink jet head.

A fluid transporting device according to embodiments of the present invention will be described while referring to the accompanying drawings wherein like part and components are designated by the same reference numerals to avoid duplicating description.

<First Embodiment>

First, an ink jet head 100, which serves as an example of a liquid transport device provided with a piezoelectric actuator according to a first embodiment of the present invention, will be described while referring to FIGS. 2 to 11.

First, an ink jet printer 101 mounted with the ink jet head 100 will be described while referring to FIG. 2.

Figure 2:
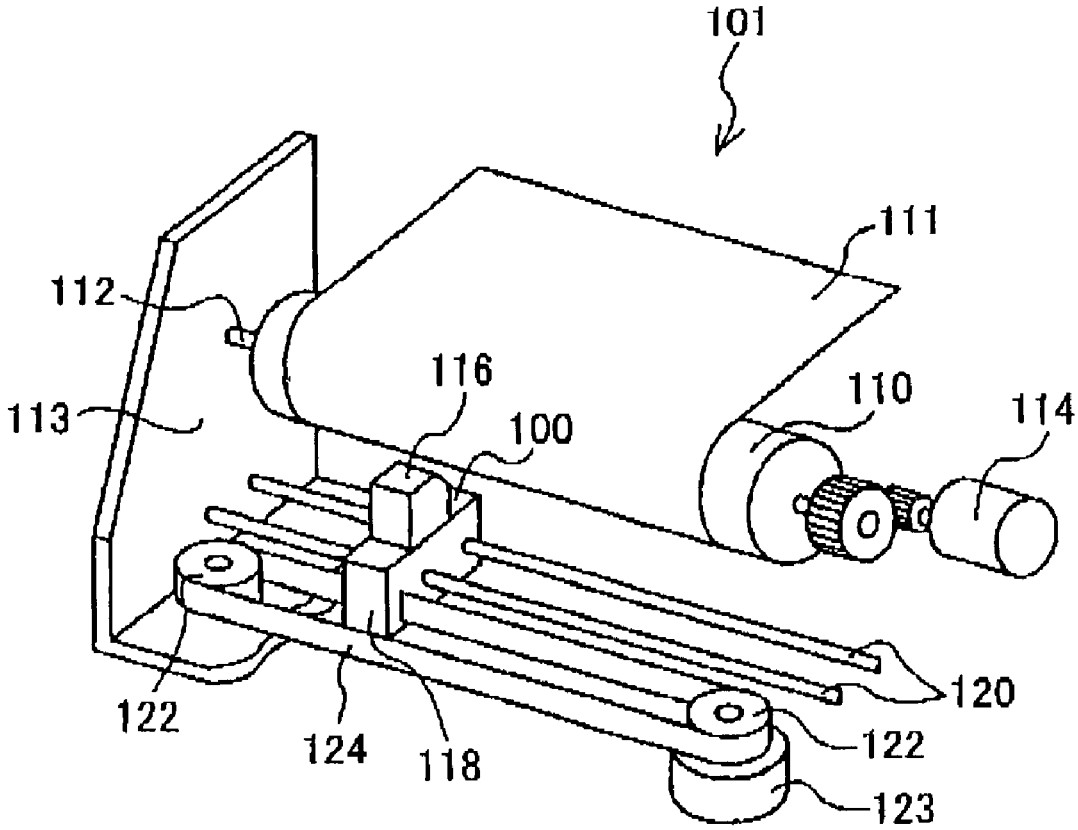
FIG. 2 is a perspective view showing essential components of an ink jet printer provided with an inkjet head having a piezoelectric actuator according to an embodiment of the present invention.

As shown in FIG. 2, the ink jet printer 101 includes a platen roller 110 and a carriage 118. The platen roller 110 is rotatably attached to a frame 113 by a shaft 112 and is driven to rotate by a motor 114 to transport sheets 111 one at a time past the carriage 118. The carriage 118 is slidably mounted on two guide rods 120, which are oriented in parallel with the rotational axis of the platen roller 110. The carriage 118 is coupled to a timing belt 124, which is provided around a pair of pulleys 122. A motor 123 is provided for driving one of the pulleys 122 in both forward and in reverse directions. The carriage 118 supports the ink jet head 100 and an ink cartridge 116. The ink jet head 100 is oriented in confrontation with the platen roller 110 at a position for printing on the sheet 111 that is set on the platen roller 110. With this configuration, the ink jet head 100 travels reciprocally back and forth in front of the sheet 111 when the motor 123 reciprocally drives the pulleys 122.

The sheet 111 is supplied from a sheet supply cassette (not shown) provided to the side of the ink jet printer 101, and transported between the ink jet head 100 and the platen roller 110. In order to print desired images on the sheet 111, the ink jet head 100 ejects ink onto the sheet 111 as the ink jet head 100 scans back and forth in front of the sheet 111 while the sheet 111 is transported between the ink jet head 100 and the platen roller 110. Afterward, the sheet 111 is discharged from the ink jet printer 101. It should be noted that configuration for supplying and discharging the sheet 111 are omitted from FIG. 2.

Next, the ink jet head 100 will he described with reference to FIGS. 3 to 11.

Figure 3:
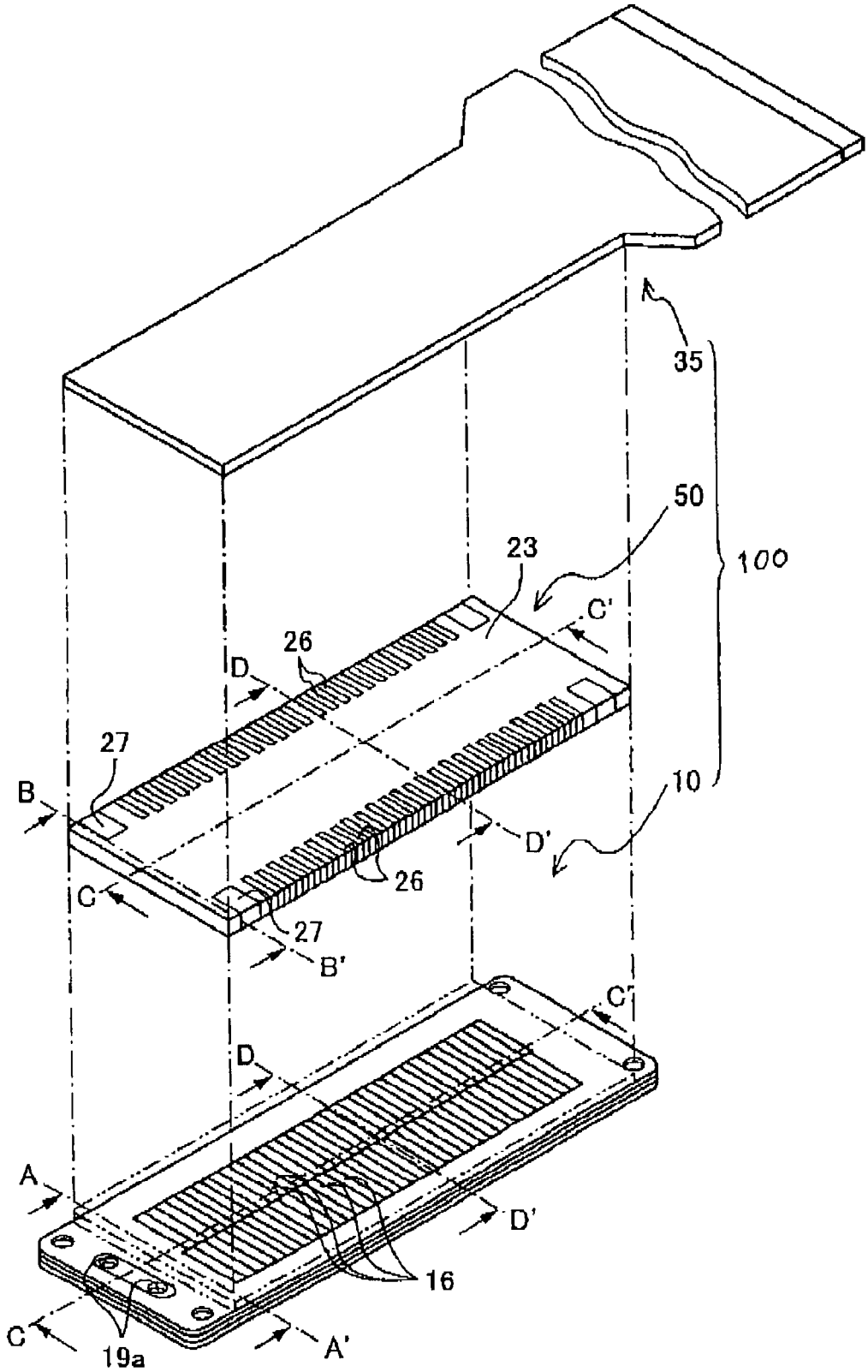
FIG. 3 is an exploded perspective view of the ink jet head.

As shown in FIG. 3, the ink jet head 100 includes a cavity plate 10, a piezoelectric actuator 50, and a flexible cable 35 stacked on top of each other and fixed in place. The piezoelectric actuator 50 has a plate shape and is adhered on top of the cavity plate 10 by adhesive or an adhesive sheet. The flexible cable 35 is adhered on top of the piezoelectric actuator 50 and is for electrically connecting the piezoelectric actuator 50 to an external device.

Figure 4:
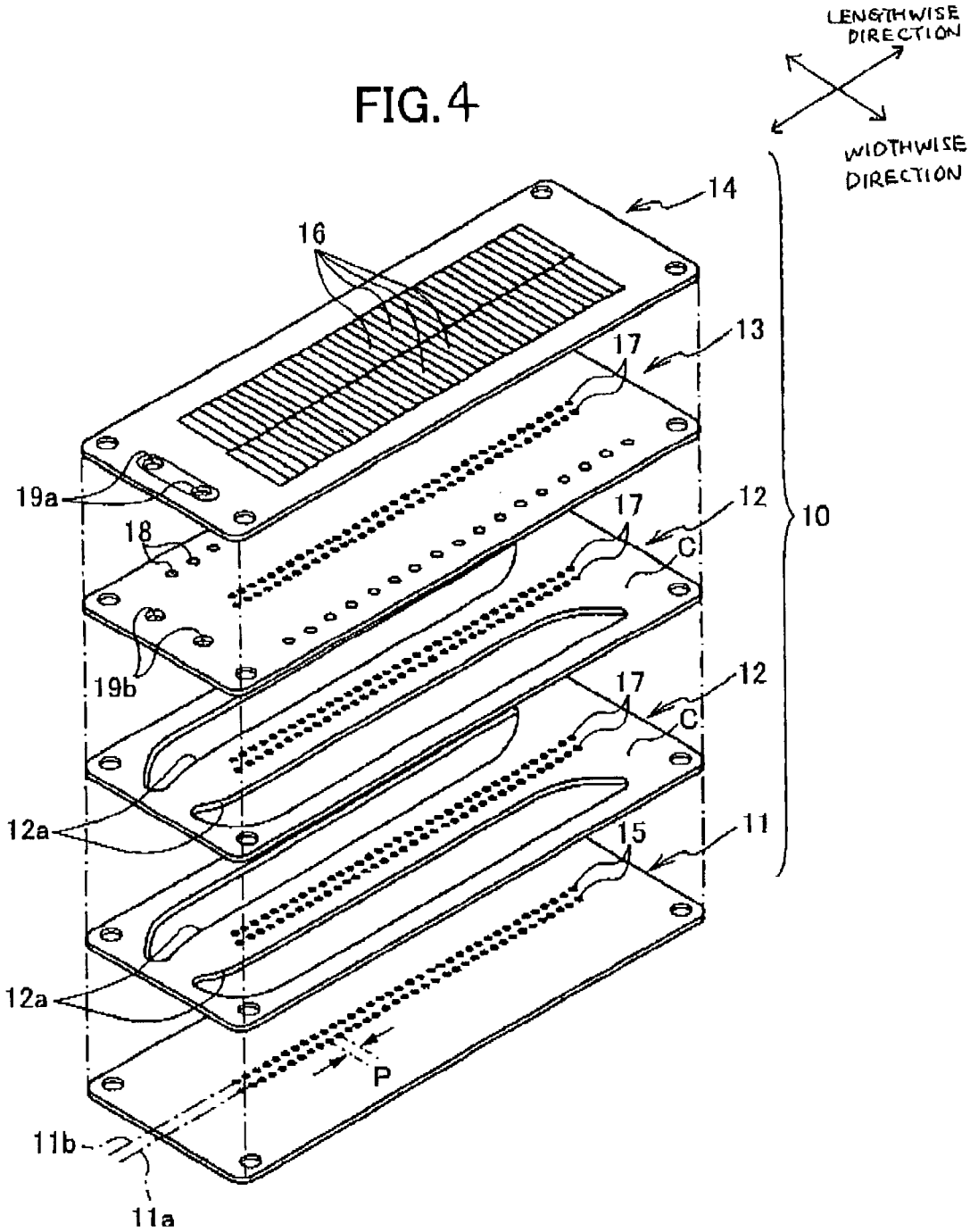
FIG. 4 is an exploded perspective view of a cavity plate in the ink jet head.

The cavity plate 10 is the lowermost layer of the ink jet head 100. As shown in FIG. 4, cavity plate 10 is made from five thin metal layers stacked one on top of the other and adhered together by adhesive. The five layers include a nozzle plate 11, two manifold plates 12, a spacer plate 13, and a base plate 14. The five plates 11–14 are formed from a metal sheet of 42% nickel alloy (42 alloy) having a thickness of about 50 to 150 microns. The nozzle plate 11 of the cavity plate 10 is formed with nozzles 15 for ejecting ink downward.

Figure 5:
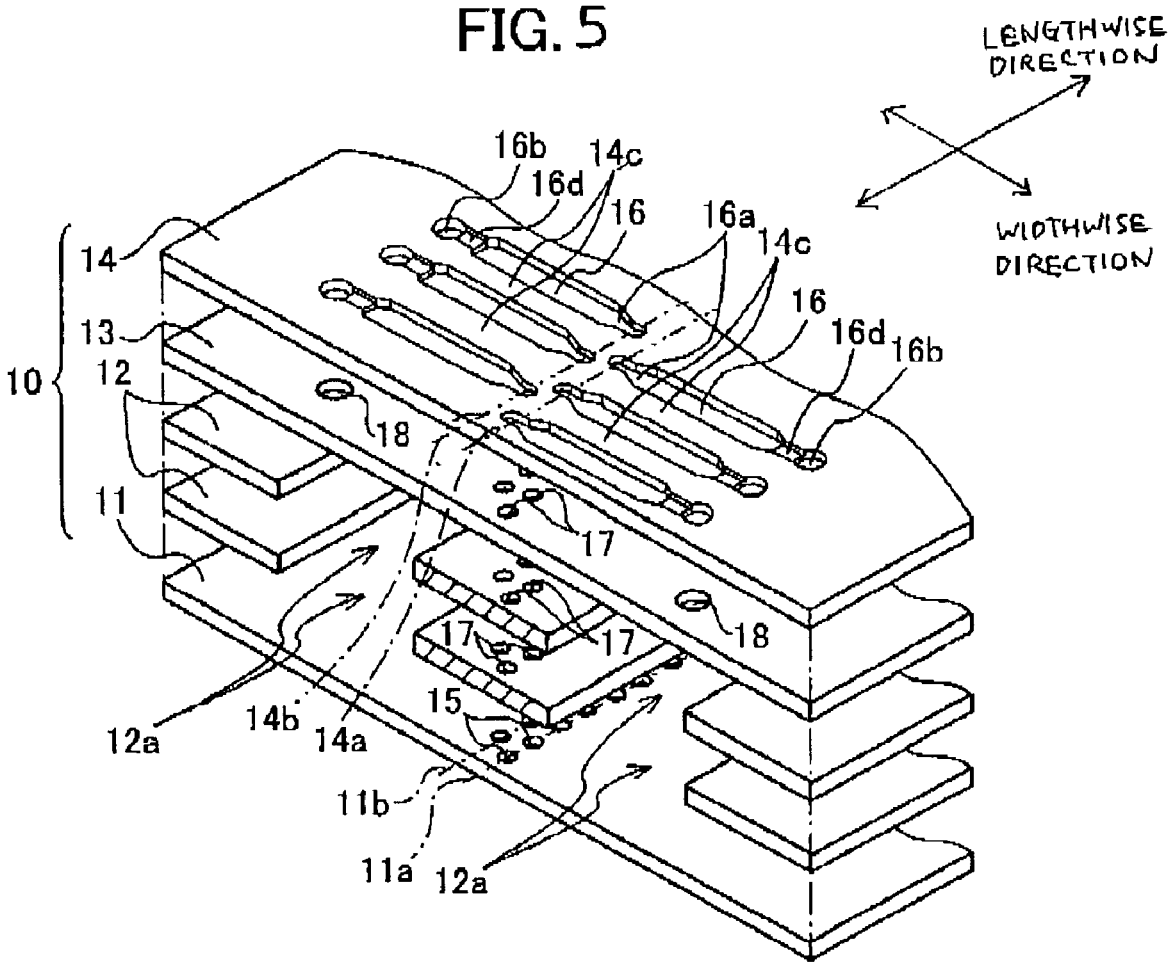
FIG. 5 is a magnified exploded perspective view taken along single-dot chain line A–A' of FIG. 3 showing essential portions of the cavity plate in the ink jet head.
Figure 7:
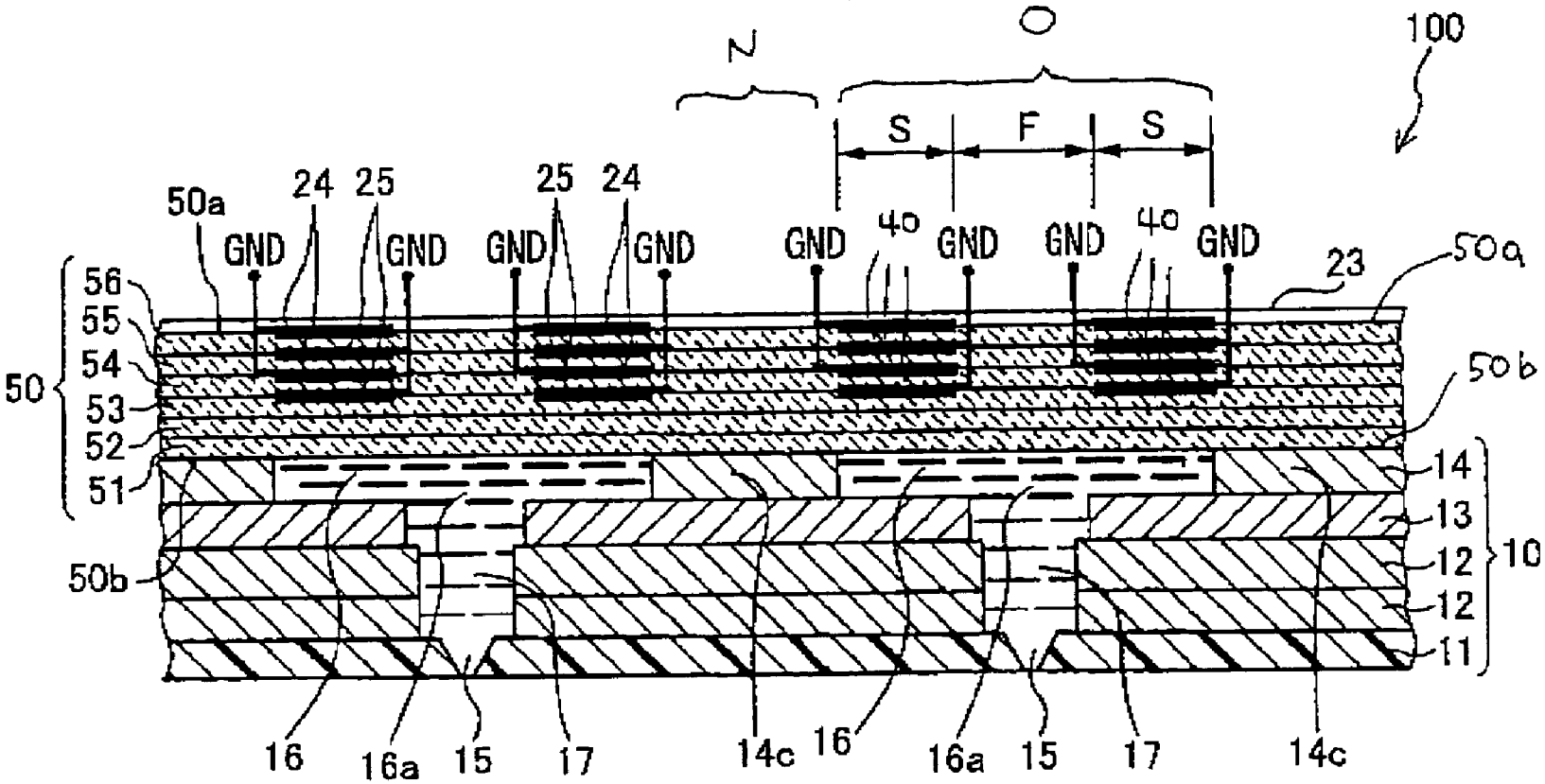
FIG. 7 is a partial cross-sectional view taken along single-dot chain line C–C' of FIG. 3 showing the ink jet head.
Figure 8:
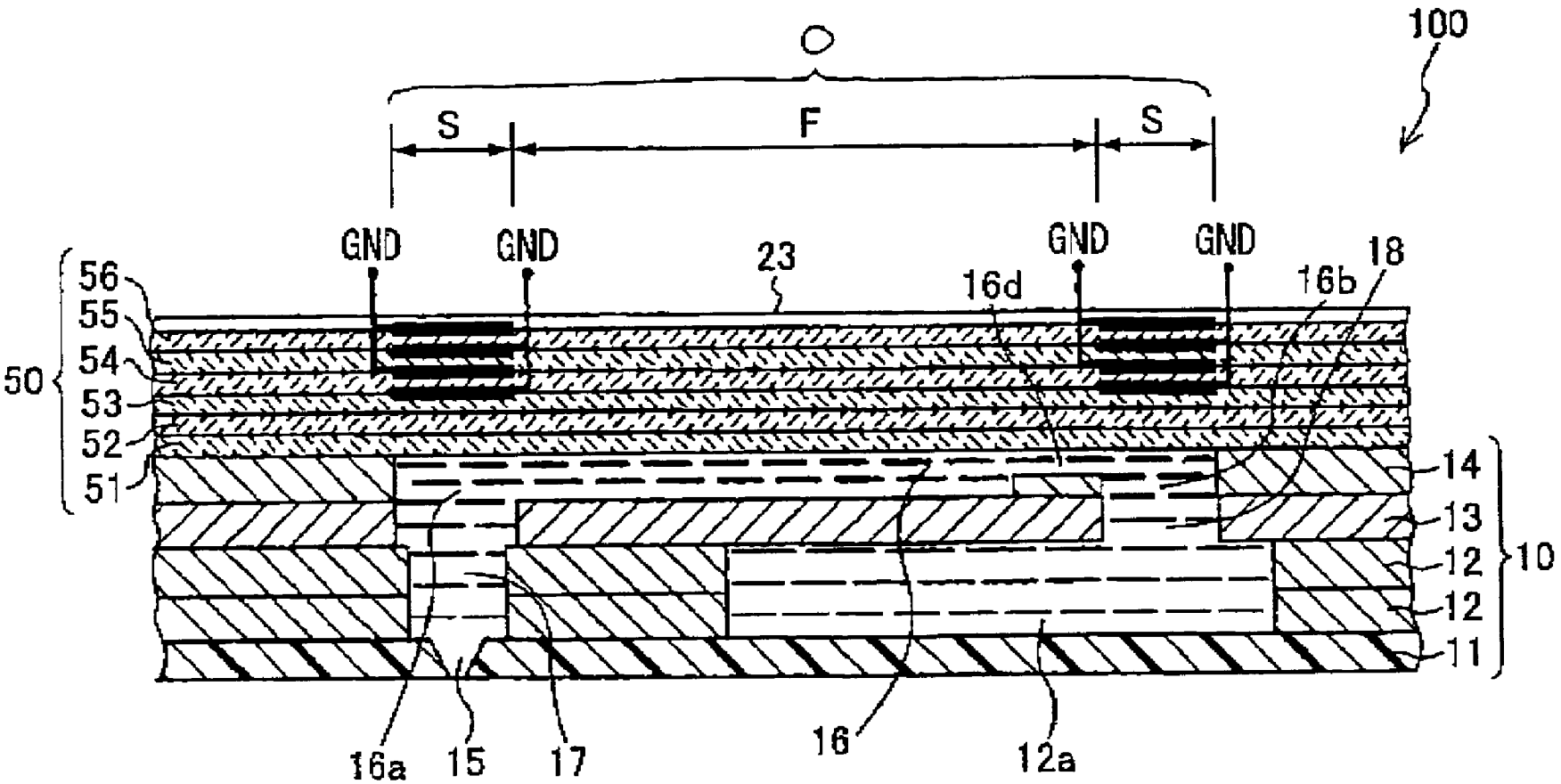
FIG. 8 is a partial cross-sectional view taken along single-dot chain line D–D' of FIG. 3 showing the ink jet head.

As shown in FIGS. 5, 7, and 8, narrow-width pressure chambers 16 are formed through the base plate 14. As shown in FIG. 5, the pressure chambers 16 are juxtaposed in two staggered rows that are aligned on imaginary center lines 14*a*, 14*b*, which indicate the lengthwise direction of the base plate 14. Each pressure chamber 16 is elongated in a direction perpendicular to the lengthwise direction of the base plate 14. Partition walls 14*c* are formed on the base plate 14 to separate adjacent pressure chambers 16. Flow regulating portions 16*d* are formed also on the base plate 14. The regulating portions 16*d* are grooves formed in fluid communication with the outward facing ends of the pressure chambers 16 with respect to the widthwise direction of the base plate 14. Ink supply holes 16*b* are opened through the base plate 14 and are in fluid communication with corresponding flow regulating portions 16*d*. Said differently, the flow regulating portions 16*d* are formed in between the ink supply holes 16*b* and the corresponding pressure chambers 16 to fluidly connect the ink supply holes 16*b* to the corresponding pressure chambers 16. The flow regulating portions 16*d* are formed with a narrower cross-sectional area than the pressure chambers 16, with respect to the direction perpendicular to flow of ink through the flow regulating portions 16*d*. The narrower cross-sectional area of the flow regulating portions 16*d* increases resistance to ink flow. The ink supply holes 16*b* of the base plate 14 are in fluid communication with common ink chambers 12*a* of the manifold plates 12 through ink supply holes 18 of the spacer plate 13.

Small-diameter through-holes 17 and the ink supply holes 18 are formed through the spacer plate 13. The small-diameter through-holes 17 are opened through the spacer plate 13, and also through the two manifold plates 12, in the same staggered pattern as the pressure chambers 16, and are fluidly connected with inward facing ends 16*a* of the pressure chambers 16 and with the nozzles 15 of the nozzle plate 15. The ink supply holes 18 are opened through the spacer plate 13 at positions that correspond to the ink supply holes 16*b* of the base plate 14, and are in fluid communication with the ink supply holes 16*b*.

As shown in FIG. 4, the spacer plate 13 is formed with ink supply holes 19*a*, and the base plate 14 is formed with ink supply holes 19*b*. The ink supply holes 19*a* and the ink supply holes 19*b* are located at corresponding positions. The ink supply holes 19*a*, 19*b* are for supplying ink from the ink cartridge 116 to the corresponding common ink chambers 12*a* of the manifold plates 12. The two common ink chambers 12*a* are opened through the manifold plates 12 following the lengthwise direction of the cavity plate 10 and are located on either side of rows in which the nozzles 15 are aligned in the nozzle plate 11. The common ink chambers 12*a* are provided in the manifold plates 12 at positions within an imaginary plane that is parallel with an imaginary plane defined by the pressure chambers 16 of the base plate 14. Because the common ink chambers 12*a* are formed in the manifold plates 12, they are located in the cavity plate 10 at positions closer to the nozzle plate 11 than to the base plate 14.

As can be seen in FIG. 4, the manifold plates 12 include an end portion C at the opposite end from the end that corresponds to the ink supply holes 19*a*, 19*b* of the base plate 14 and the spacer plate 13. The portion of each common ink chamber 12*a* in the end portion C is shaped to decrease cross-sectional area at a fixed rate with distance from the ink supply holes 19*a*, 19*b*. This shape facilitates the discharge of residual air bubbles that can easily collect in the far end portions of the common ink chambers 12*a*. The common ink chambers 12*a* are sealed by the nozzle plate 11 and the spacer plate 13 stacked on either end of the manifold plates 12.

The nozzles 15 are formed through the nozzle plate 11 aligned in two rows that follow imaginary center lines 11*a*, 11*b*, which extend in the lengthwise direction of the nozzle plate 11. Each nozzle 15 has a small diameter of about 25 microns. The nozzles 15 of the different rows are staggered from each other and adjacent nozzles 15 of the same row are separated by a pitch P. Each nozzle 15 corresponds to one of the through-holes 17 of the manifold plates 12, and consequently to one of the pressure chambers 16 of the base plate 14.

Figure 6:
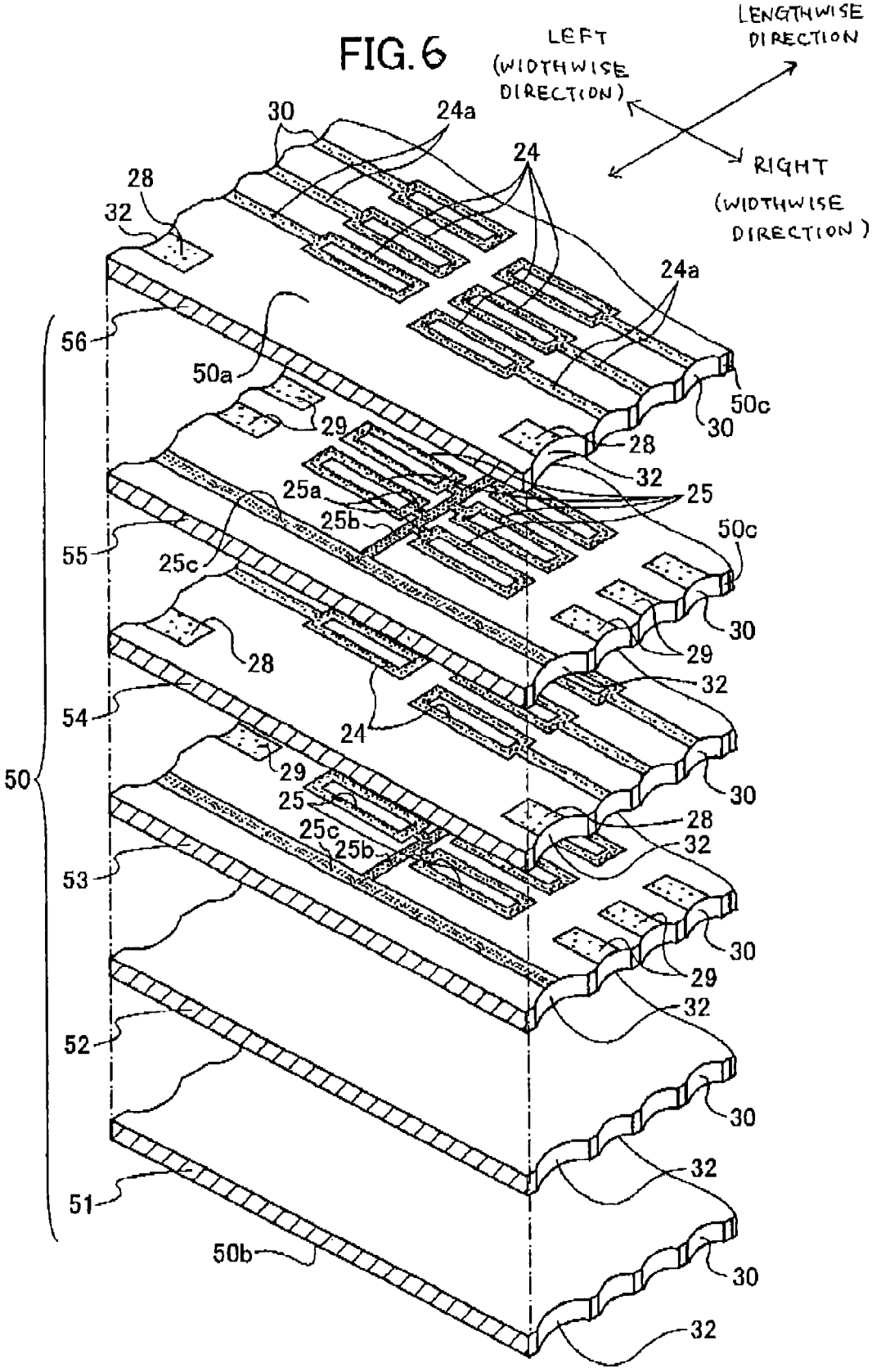
FIG. 6 is a magnified exploded perspective view taken along single-dot chain line B–B' of FIG. 3 showing essential portions of a piezoelectric actuator in the ink jet head.

As shown in FIGS. 6 to 8, the piezoelectric actuator 50 is formed from a stack of six piezoelectric sheets 51, 52, 53, 54, 55, 56 formed from a lead zirconate titanate (PZT) type piezoelectric ceramic material. The piezoelectric sheets 54, 56 are formed with drive electrodes 24 at their upper surfaces. The piezoelectric sheets 53, 55 are formed with ground electrodes 25 at their upper surfaces. The electrodes 24, 25 are formed, for example, by screen printing using a conductive paste material or by deposition of a conductive material.

The drive electrodes 24 are provided in a staggered array in a one-to-one correspondence to the pressure chambers 16 of the cavity plate 10. Each of the drive electrodes 24 has a rectangular frame shape that is elongated in the direction perpendicular to the lengthwise direction of the piezoelectric sheets 54, 56 in the planar direction of the cavity plate 10. The rectangular frame shape of each drive electrode 24 follows the outer periphery of the corresponding pressure chamber 16. A wiring portion 24*a* extends from one end of each drive electrode 24 to the nearest of the left or right side 50*c* of the piezoelectric actuator 50. The left and right sides 50*c* of the piezoelectric actuator 50 extend in the lengthwise direction of the piezoelectric actuator 50 and extend perpendicular to top and bottom surfaces 50*a*, 50*b* of piezoelectric actuator 50.

The ground electrodes 25 serve as a common ground electrode for the pressure chambers 16. The ground electrodes 25 have the same shape as the drive electrodes 24 and are provided in a staggered array with positioning that corresponds to the drive electrodes 24. A wiring portion 25*a* extends from one end of each of the ground electrodes 25. The wiring portions 25*a* are connected to a common wiring portion 25*b* that extends in the lengthwise direction along the center of piezoelectric sheets 53, 55. The ends of the common wiring portion 25*b* are connected to common wiring portions 25*c*, which extend following the lengthwise ends of the piezoelectric sheets 53, 55 in the widthwise direction of the piezoelectric actuator 50. Both ends of the common wiring portions 25*c* are exposed on corresponding ones of the left and right side surfaces 50*c* in the same manner as the wiring portions 24*a* of the drive electrodes 24.

It should be noted that electrodes 28, 29 are formed following the lengthwise sides of the piezoelectric sheets 53–56 at positions that correspond to the wiring portions 24*a*, 25*c*. The electrodes 28, 29 serve as dummy patterns.

First and second grooves 30, 32 are formed in the left and right side surfaces 50*c* of the piezoelectric actuator 50 so as to extend in the direction in which the piezoelectric sheets 51–56 are stacked. The first grooves 30 are positioned at positions of the dummy pattern electrodes 29 and the wiring portions 24*a* of the drive electrodes 24. The second grooves 32 are positioned at positions of the dummy patterns 28 and the common wiring portions 25*c* of the ground electrodes 25. Although not shown in the drawings, side-surface electrodes are formed in the first and second grooves 30, 32. The side-surface electrodes in the first grooves 30 are electrically connected to the drive electrodes 24 and to the dummy pattern electrodes 29 and the side surface electrodes in the second grooves 32 are electrically connected to the ground electrodes 25 and the dummy pattern electrodes 28.

As shown in FIG. 3, an insulating sheet 23 is adhered to the upper surface of the piezoelectric actuator 50 that is, to the upper surface of the piezoelectric sheet 56. Electrodes 26, 27 are provided on the insulation sheet 23. The side surface electrodes in the grooves 30, 32 are connected to electrodes 26, 27. That is, the drive electrodes 24 are electrically connected to the electrodes 26 and the ground electrodes 25 are connected to the electrodes 27. The electrodes 26, 27 are connected to corresponding contact points (not shown) of the flexible cable 35. It should be noted that the electrodes can be connected to the flexible cable 35 alternatively by through-holes opened through the stacking direction of the piezoelectric sheets.

Figure 9:
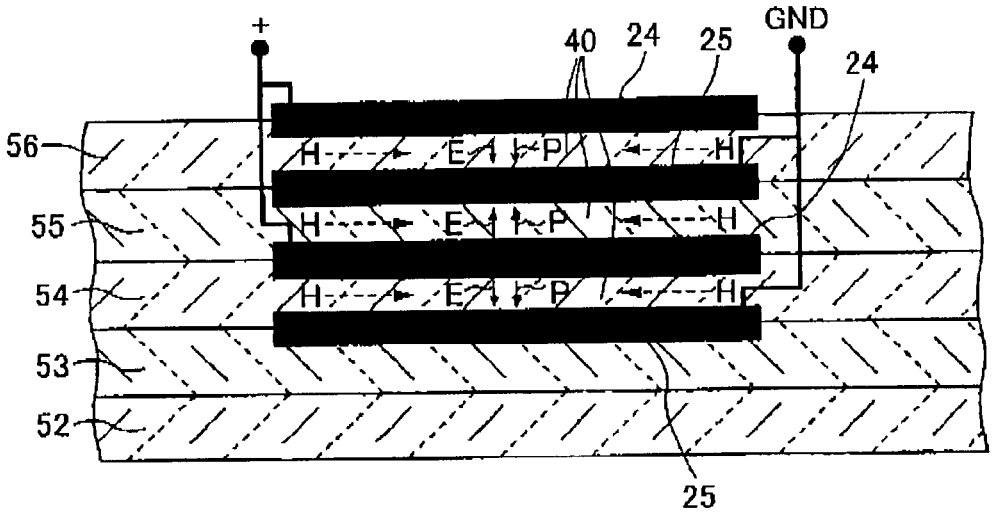
FIG. 9 is a magnified partial cross-sectional view of the piezoelectric actuator.

To form the piezoelectric actuator 50, the piezoelectric sheets 54, 56, which are formed with the drive electrodes 24, are stacked in alternation with the piezoelectric sheet 53, 55, which are formed with the ground electrodes 25. Then, the sheets 51, 52, which are not formed with any electrodes, are stacked on the pressure chamber 16 side of the piezoelectric sheet 53. The stack of piezoelectric sheets 51–56 are then sintered into an integral block. In a well-known manner, the piezoelectric material is polarized by connecting the ground electrodes 25 to ground (GND)) and applying the drive electrodes 24 with a high, positive voltage through the electrodes 26, 27. As shown in FIG. 9, the portions 40 of the piezoelectric sheets 54, 55, 56 interposed between the electrodes 24, 25 in the stacking direction are polarized in a direction P from the drive electrodes 24 to the ground electrodes 25. These portions function as active portions 40 to be described later.

As mentioned previously, the electrodes 24, 25 of the piezoelectric actuator 50 are shaped and positioned to follow the outer periphery of the pressure chambers 16 as viewed in plan.

As shown in FIGS. 7 and 8, the piezoelectric actuator 50 includes an operation portion O for each pressure chamber 16. Each operation portion O has a first portion F and a pair of second portions S on either side of the first portion F.

The bottom surface 50*b* of the piezoelectric actuator 50 is fixed to the upper surface of the cavity plate 10 with each operation portion O located above a corresponding pressure chamber 16. The portion N of the piezoelectric actuator 50 in between adjacent operation portions O, that is, the outer side of the second portions S with respect to the first portions F, is positioned above the partition walls 14*c* between the pressure chambers 16.

In each operation portion O, the first portion F is located substantially above, in the stacking direction, the central portion of the corresponding pressure chamber 16. In each operation portion O, the second portions S encompass the corresponding first portion F. As viewed in cross section in FIG. 7, a pair of second portions S, which are actually connected together in an encompassing rectangular-frame shape, are provided in each operation portion O, with one of the second portion S being positioned on either side of each first portion F.

The electrodes 24, 25 are located within the second portions S at positions shifted in the thickness direction of the second portion S away from the corresponding pressure chamber 16. That is, the electrodes 24, 25 are located at the far side of the second portion S from the pressure chamber 16.

The active portions 40 of the piezoelectric sheets 54, 55, 56, which are interposed between the electrodes 24, 25 and which are polarized in the staking direction of the piezoelectric sheets 54, 55, 56, deform due to the piezoelectric effect, when applied with voltage. The entire operation portion O serve as a pressure generating portion to deform based on deformation of the active portions 40.

In this way, according to the present embodiment, the electrodes 24 and 25 are disposed on the upper sides of the piezoelectric sheets 53–56. Accordingly, the active portions 40, defined between the electrodes 24 and 25, are provided in the piezoelectric sheets 54–56 which are located nearer to the top surface 50*a* of the piezoelectric actuator 50 than to the bottom surface 50*b* of the piezoelectric actuator 50 that is connected to the cavity plate 10.

As shown in FIG. 7, in an initial condition of the ink jet head 100 before ink is ejected, the drive electrodes 24 and the ground electrodes 25 are all connected to ground (GND) and so have an electric potential of 0V. Also, ink supplied from the common ink chambers 12*a* fills the fluidly connected channel from the pressure chambers 16 to the tip of the nozzles 15.

Figure 10:
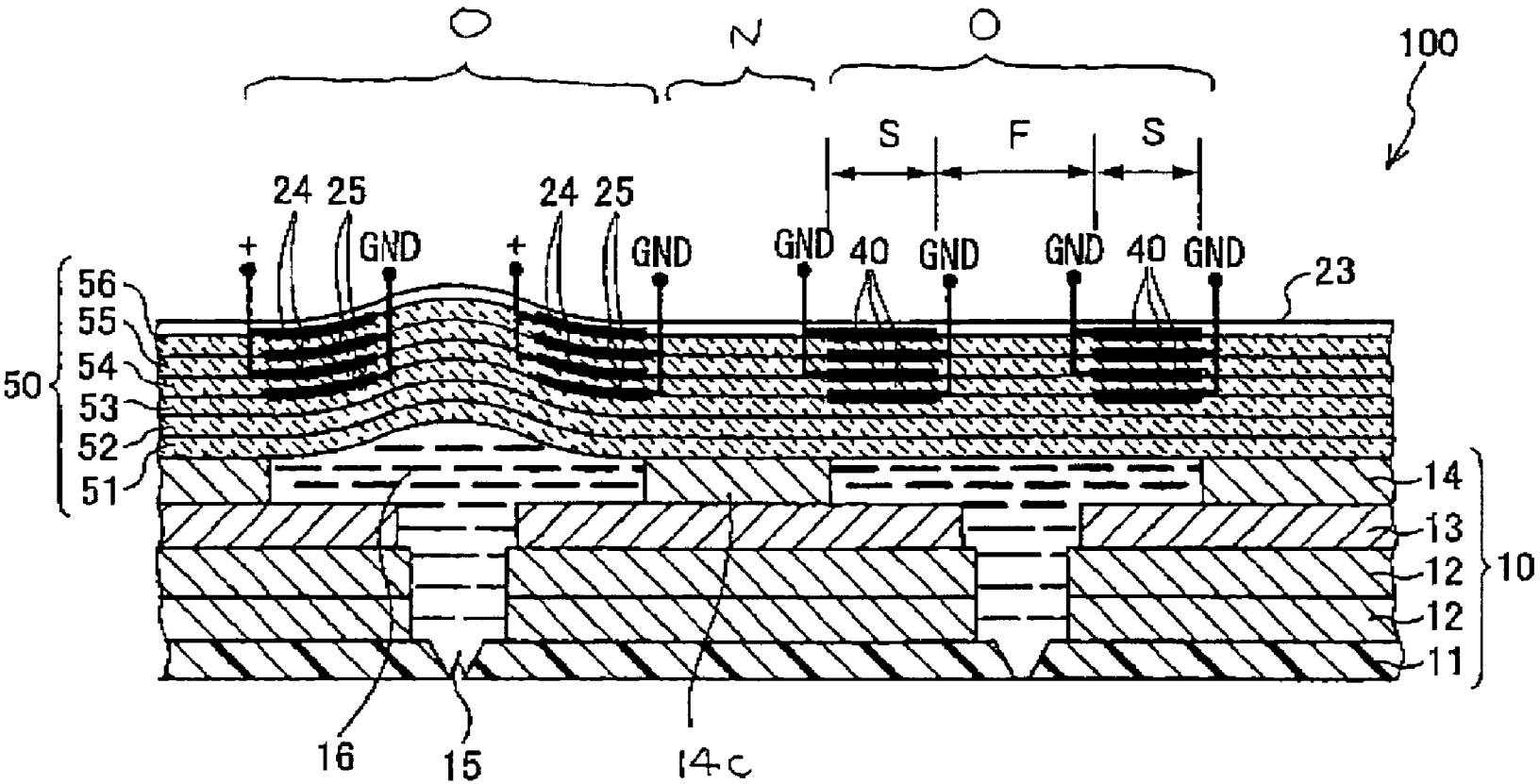
FIG. 10 is a partial cross-sectional view corresponding to FIG. 7, showing the piezoelectric actuator applied with voltage.

When, according to print data from an external source, ink is to be ejected from a single nozzle 15 in fluid communication with one of the pressure chambers 16, then as shown in FIG. 10, the operation portion O that corresponds to the pressure chamber 16 is energized. That is, a drive voltage is applied to the active portions 40 of piezoelectric sheets 54–56 that reside in the pair of second portions S of the subject operation portion O. A drive voltage of, for example, 20V is applied to the drive electrodes 24 while the ground electrodes 25 are maintained in connection with ground. Because, as shown in FIG. 9, the direction P of polarization matches the direction E of the electric field, the piezoelectric vertical effect elongates the active portions 40 of the piezoelectric sheets 54–56 located between the electrodes 24 and 25 in the direction P of polarization. It is noted that each active portion 40 of the piezoelectric sheet 54–56 between the electrodes 24 and 25 is wider in the horizontal direction H, which is perpendicular to the direction P of polarization, than it is thick in the direction P of polarization. Therefore, the piezoelectric horizontal effect greatly contracts the active portion 40 of each piezoelectric sheet 54–56 in the planar direction H.

In this way, in the energized operation portion O, the polarized active portions 40 of piezoelectric sheets 54–56 contract in the planar direction H. However, non-polarized portions of piezoelectric sheets 51–53 which are sandwiched between no electrodes and which are located below the active portions 40 of piezoelectric sheets 54–56, do not deform. Rather, the non-polarized portions of piezoelectric sheets 51–53 elongate or extend in accordance with the contracting operation of the polarized active portions 40. Therefore, as shown in FIG. 10, the second portion S overall bends in an arch shape with the active portions 40 of piezoelectric sheets 54–56 being positioned at the valley of the arch. In other words, the second portion S bends in a downward arch shape. Because the outer side N of the second portion S is fixed to one partition wall 14*c*, the second portion S arches or curves so that its side nearer the first portion F is greatly shifted in a direction away from the cavity plate 10.

It is noted that the pair of second portions S that follow the perimeter of the same pressure chamber 16 arch symmetrically with respect to the center of the corresponding first portion F. Therefore, the arching action of the second portions S presses the corresponding first portion F to protrude upward in the direction substantially perpendicular to the planar direction H of the piezoelectric actuator 50, that is, away from the cavity plate 10. In this way, both the first and second portions F, S archinly deform in the direction that increases the volume of the pressure chamber 16. In other words, the operation portion O entirely deforms to increase the volume of the pressure chamber 16. As a result, the pressure in the pressure chamber 16 reduces to a negative pressure so that ink is drawn into the pressure chamber 16 from the common ink chamber 12*a*.

Figure 11:
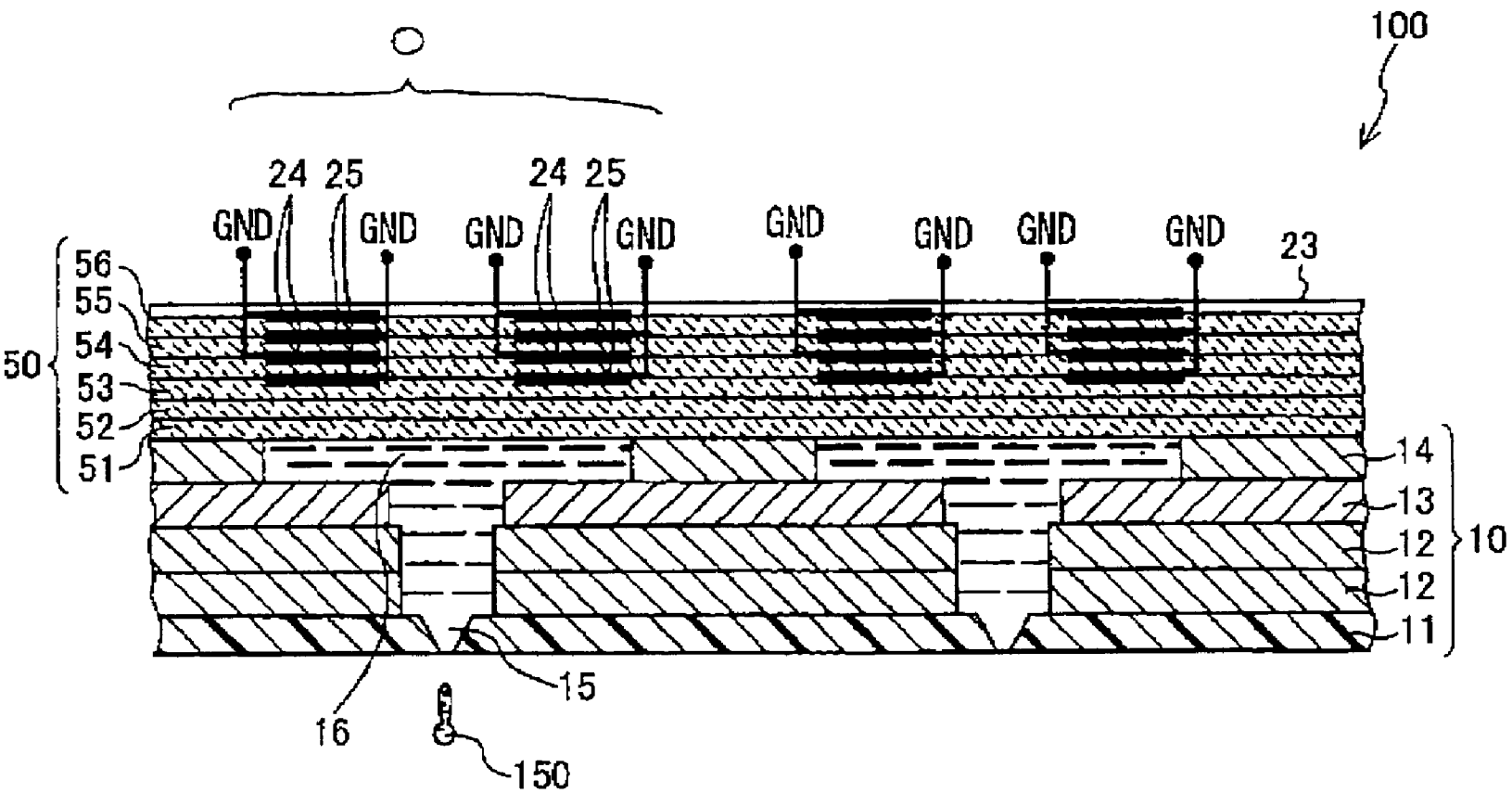
FIG. 11 is a partial cross-sectional view corresponding to FIG. 7, showing the piezoelectric actuator after application of voltage is stopped.

At this time, pressure waves are generated in the pressure chamber 16. As is well known, when the time required for the pressure waves to propagate once across the length of the pressure chamber 16, the pressure in the pressure chamber 16 switches to a positive pressure. Therefore, the voltage applied to the drive electrodes 24 is switched to 0V at this timing. As shown in FIG. 11, the operation portion O of the piezoelectric actuator 50 returns to its initial condition of before deforming. The first and second portions F, S in the operation portion O resiliently revert to a flat shape.

The pressure from the positive pressure wave and the pressure generated when the piezoelectric actuator 50 reverts to its initial condition combine to generate a relatively high pressure near the nozzle 15, and an ink droplet 150 is ejected as a result. In this way, the ink jet head 100 of the present embodiment can eject droplets by driving the operation portion O to first increase the volume of the pressure chamber 16 and then to return the volume back to the initial condition.

As described above, according to the present embodiment, the electrodes 24, 25 are provided only to the second portions 5 in the operation portion O. Because the electrodes 24, 25 are provided only to a small portion in the operation portion O, only a small surface area of the piezoelectric layers is positioned between the electrodes 24, 25. Accordingly, the operation portion O has a small capacitance. High energy efficiency is attained. Contraction of the active portions 40 in the planar direction H is developed at one side of the pair of second portions S that is furthest from the cavity plate 10. This contraction causes the pair of second portions S to arch downwardly, which in turn causes the first portion F, located between the pair of second portions S, to archingly deform upwardly in a direction substantially perpendicular to the planar direction H. As a result, a large amount of deformation can be achieved for the first and second portions F, S together. Even though the electrodes 24, 25 are provided only to a small portion in the operation portion O, a broader portion of the operation portion O can be bent.

The piezoelectric actuator 50 is fixed to the partition wall 14*c* at its portion N to the outside of the second portion S with respect to the first portion F. Accordingly, the second portion S deforms greatly at the side thereof opposite from the partition wall 14*c*. As a result, the first and second portions F, S in total deform greatly away from the pressure chamber 16, thereby greatly increasing the volume of the pressure chamber 16.

Also, because a plurality of pair of electrodes 24 and 25 are disposed between the stacked piezoelectric sheets 53–56, it is possible to generate a strong electric field even by applying a small amount of drive voltage between each pair of electrodes 24 and 25.

According to the present embodiment, the electrodes 24, 25 are disposed at positions in the second portion S that is farthest from the pressure chamber 16. Accordingly, the active portions 40 of the piezoelectric sheets located between the electrodes 24, 25 are also disposed at positions in the second portion S that is farthest from the pressure chamber 16. The active portions 40 are first contracted in the planar direction H to deform the first and second portions F, S in the direction that increases the volume of the pressure chamber 16. Then, the active portions 40 are returned to their initial conditions to reduce the volume of the pressure chamber 16. As a result, pressure fluctuations are generated in the ink in the pressure chamber 16. The pressure fluctuations are used to efficiently eject the ink. Accordingly, ink can be transported by applying voltage to the electrodes 24, 25 in order only to increase the volume in the pressure chamber 16. The device is safer and energy is more efficiently used.

As described above, according to the present embodiment, the first portion F is positioned above the center of the pressure chamber 16. The pair of second portions S are disposed on either side of the first portion F. The electrodes 24, 25 are positioned in the second portion S to the side farthest in the thickness direction from the pressure chamber 16. When voltage is developed between the electrodes 24, 25, the polarized active portions 40 of the piezoelectric sheets 54–56 that are sandwiched between the electrodes 24, 25 contract in the planar direction, so that the second portion S arches downward. As a result, the first portion F is pushed upward and protrudingly arches upward so that the volume of the pressure chamber 16 increases. Accordingly, the operation portion O can be deformed by a large deformation amount even if the portion of the stacked piezoelectric sheets positioned between the electrodes has a small surface area in the planar direction.

<Modification>

Next a modification of the first embodiment will be described with reference to FIGS. 12(A) and 12(B).

In the first embodiment, the piezoelectric actuator 50 is formed with the electrodes 24, 25 which is located furthest from the cavity plate 10 in the second portion S. With this configuration, the volume in the pressure chamber 16 is first increased and then returned to the initial state, thereby applying pressure to the ink in the pressure chamber 16.

Figure 12A:
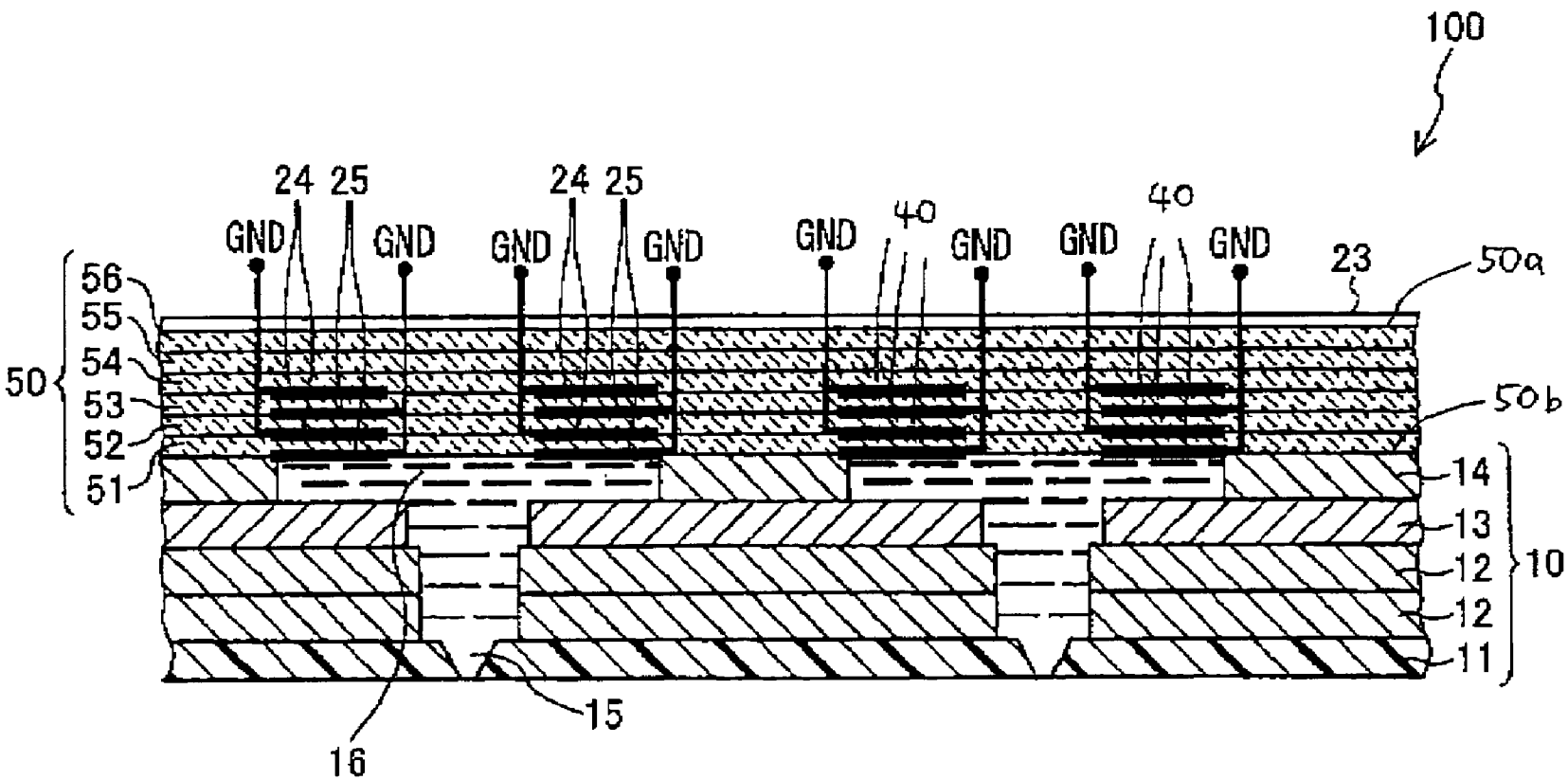
FIG. 12(A) is a partial cross-sectional view that corresponds to FIG. 7, showing an ink jet head having an piezoelectric actuator according to a modification of the first embodiment, before a voltage is applied to the piezoelectric actuator.

However, in this modification, the piezoelectric actuator 50 is formed with the electrodes 24, 25 which are located next to the cavity plate 10 as shown in FIG. 12(A). That is, the electrodes 24 and 25 are disposed on the lower sides of the piezoelectric sheets 51–54. Portions 40 of the piezoelectric layers 51, 52, and 53 are interposed between the electrodes 24 and 25. The portions 40 are polarized in the same manner as described for the first embodiment. Accordingly, the polarized active portions 40 are provided in the piezoelectric sheets 51–53 which are located nearer to the bottom surface 50*b* than to the top surface 50*a*.

With this configuration, pressure can be applied by reducing the volume in the pressure chamber 16 from the initial state.

Figure 12B:
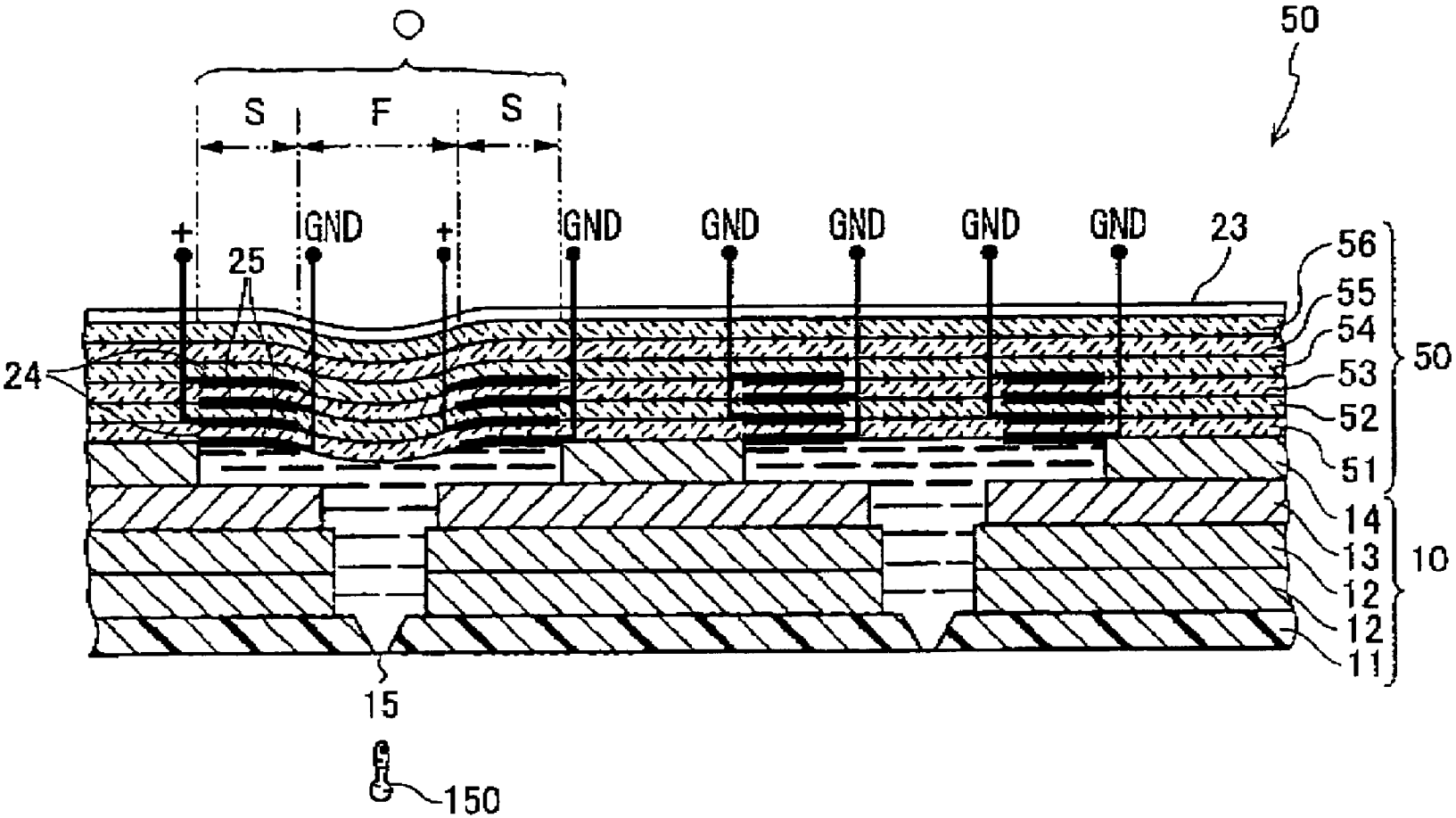
FIG. 12(B) is a partial cross-sectional view showing the ink jet head of FIG. 12(A) after voltage is applied to the piezoelectric actuator.

More specifically, when a voltage is applied to the electrodes 24 in this configuration, then the first and second portions F, S deform in the same manner as described in the first embodiment, although in the opposite direction as shown in FIG. 12(B) so that the operation portion O protrudes into the pressure chamber 16. This decreases the volume in the pressure chamber 16 to apply ejection pressure to the ink. As a result, an ink droplet 150 is ejected through the nozzle 15.

In this modification, the electrodes 24, 25 are located at the side of the second portions S that is near the pressure chambers 16. The polarized active portions 40 between the electrodes 24, 25 are contracted in the planar direction H so that the first and second portions F, S deform in a direction that reduces the volume of the pressure chamber 16. As a result, ink is efficiently ejected from the pressure chamber 16.

It is noted that the configuration of this modification can be alternatively obtained by simply turning the piezoelectric actuator 50 of the first embodiment upside down.

<Second Embodiment>

Next, an ink jet head 100 including a piezoelectric actuator 50 according to a second embodiment of the invention will be described while referring to FIG. 13(A).

It should be noted that the ink jet head 100 includes a cavity plate 10 with the same configuration as the cavity plate 10 of the first embodiment.

In the same manner as in the first embodiment, the piezoelectric actuator 50 has an operation portion O for every pressure chamber 16, and has a first portion F and a pair of second portions in each operation portion O.

In the present embodiment, in the second portions S, the electrodes 24, 25 are provided on the upper sides of the piezoelectric sheets 51–53 that are located close to the pressure chambers 26 in the thickness direction of the piezoelectric actuator 50. Accordingly, the electrodes 24 and 25 are disposed between adjacent layers of the piezoelectric sheets 51–54 in the direction in which the piezoelectric sheets are stacked.

In the first embodiment, each electrode 24, 25 has a width substantially entirely covering the corresponding second portion S. The electrodes 24 and 25 are therefore alternately provided among the stacked piezoelectric sheets.

However, according to the preset embodiment, each electrode 24, 25 has a width much smaller than the entire width of the second portion S. Accordingly, both the electrodes 24 and 25 are provided on the same piezoelectric sheet side by side in the planar direction H. The electrode 25 has a narrow-width rectangular frame shape following the outer periphery of the corresponding pressure chamber 16. The drive electrode 24 has another narrow-width, but smaller-sized rectangular frame shape that is surrounded by and separated from the rectangular frame of the ground electrode 25. In this way, the drive electrode 24 is disposed at a position separated from the ground electrode 25, and to the inside of the ground electrode 25 in the planar direction H.

The active portions 40 are defined in the piezoelectric sheets 52 and 53 at locations between the electrodes 24 and 25. The active portions 40 are polarized in a direction P from the inner-side drive electrode 24 to the outer-side ground electrode 25 by applying a high, positive voltage to the drive electrodes 24 and connecting the ground electrodes 25 to ground.

In this way, according to the present embodiment, the active portions 40, defined between the electrodes 24 and 25, are provided in the piezoelectric sheets 52–53 which are located nearer to the bottom surface 50*b* than to the top surface 50*a*.

Operation of the piezoelectric actuator 50 with drive and ground electrodes 24, 25 disposed as described above will be described below.

In the same way as in the first embodiment, initially the drive electrodes 24 and the ground electrodes 25 are connected to ground. Then, when print data indicates that ink is to be ejected from some nozzle 15, then, while maintaining the ground electrodes 25 in connection with ground, a drive voltage is applied to the drive electrode 24 that corresponds to the pressure chamber 16 that is in fluid communication with the nozzle 15. As a result, an electric field E is generated from the inner-side drive electrode 24 toward the outer-side ground electrode 25, which is the same direction as the direction P of polarization. Due to the piezoelectric vertical effect, the active portion 40 is extended to increase the distance between the electrodes 24 and 25 in the planar direction H.

In this way, in the second portion S, the piezoelectric sheets 51–53 attempt to elongate in the planar direction H. However, non-polarized portions of the piezoelectric sheets 54–56, which are provided with no electrodes, do not deform. As a result, the second portion S deforms in unimorphic deformation. That is, the second portion S archinly deforms, with the piezoelectric sheets 54–56 to the inner side of the arch. In other words, the second portion S arches downwardly. However, because, as in the first embodiment, the second portion S is fixed at its portion that is nearer to the partition wall 14*c*, the second portion S deforms greatly upward at its portion that is nearer to the center of the pressure chamber 16. In association with this, the first portion F archingly protrudes upward away from the pressure chamber 16. As a result, the entire operation portion O deforms to increase the volume of the pressure chamber 16.

When application of voltage to the drive electrodes 24 is stopped, then the operation portion O resiliently reverts to its flat condition so that pressure is applied to the ink in the pressure chamber 16, and ink is ejected from the nozzle 15.

According to the present embodiment, in association with extension of the active portions 40 in the second portions S in the planar direction H, the first portion F between the pair of second portions S archingly deforms to protrude upwardly in the direction substantially perpendicular to the planar direction H. As a result, the total deformation of the first and second portions F, S is altogether very large. Accordingly, the total deformation of the operation portion O is very large. Even though the electrodes 24, 25 are disposed only at a small portion of the operation portion O, bending deformation can be generated over a large area. Accordingly, the operation portion O has a small capacitance, and energy efficiency is enhanced.

In the present embodiment, the electrodes 24, 25 are positioned in the second portions S at location nearer to the pressure chamber 16. Accordingly, the active portions 40, created between the electrodes 24, 25, are formed in the piezoelectric actuator 50 also at location nearer to the pressure chamber 16. By extending the active portions 40 in the planar direction H, the first and second portions F, S deform in the direction for increasing volume of the pressure chamber 16. Afterward, the first and second portions F, S are returned to their initial shape to reduce volume in the pressure chamber 16. As a result, the pressure fluctuations generated in the ink in the pressure chamber 16 is used to efficiently eject ink. Because ink can be ejected by applying voltage to the electrodes 24, 25 in order only to increase the volume of the pressure chamber 16, safety is increased and energy efficiency is enhanced.

<Modification>

Next a modification of the second embodiment will be described with reference to FIG. 13(B).

In the second embodiment, the piezoelectric actuator 50 is formed with the electrodes 24, 25 which are located near to the cavity plate 10 in each second portion S. With this configuration, the volume in the pressure chamber 16 is first increased and then returned to the initial state, thereby applying pressure to the ink in the pressure chamber 16.

Figure 13A:
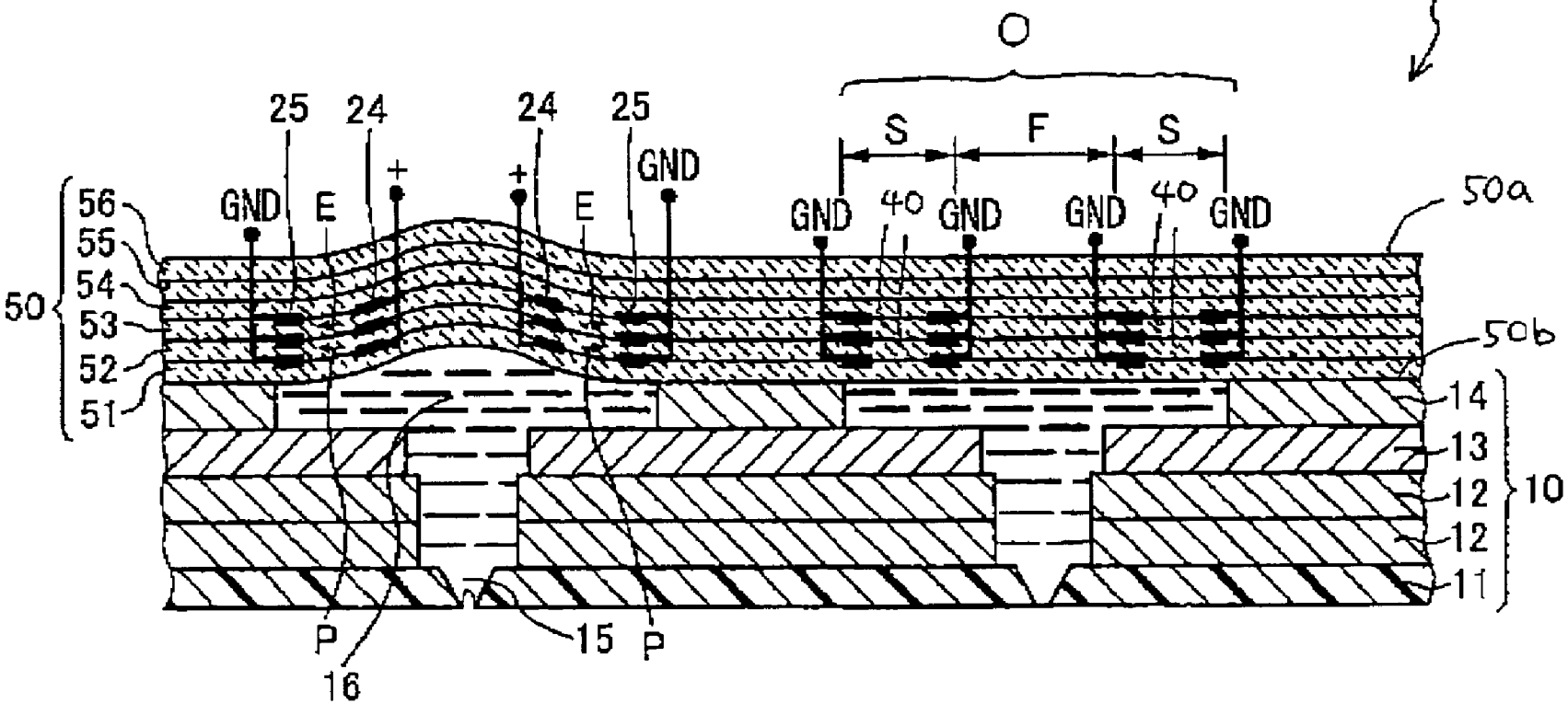
FIG. 13(A) is a partial cross-sectional view that corresponds to FIG. 7, showing an ink jet head having an piezoelectric actuator according to a second embodiment.
Figure 13B:
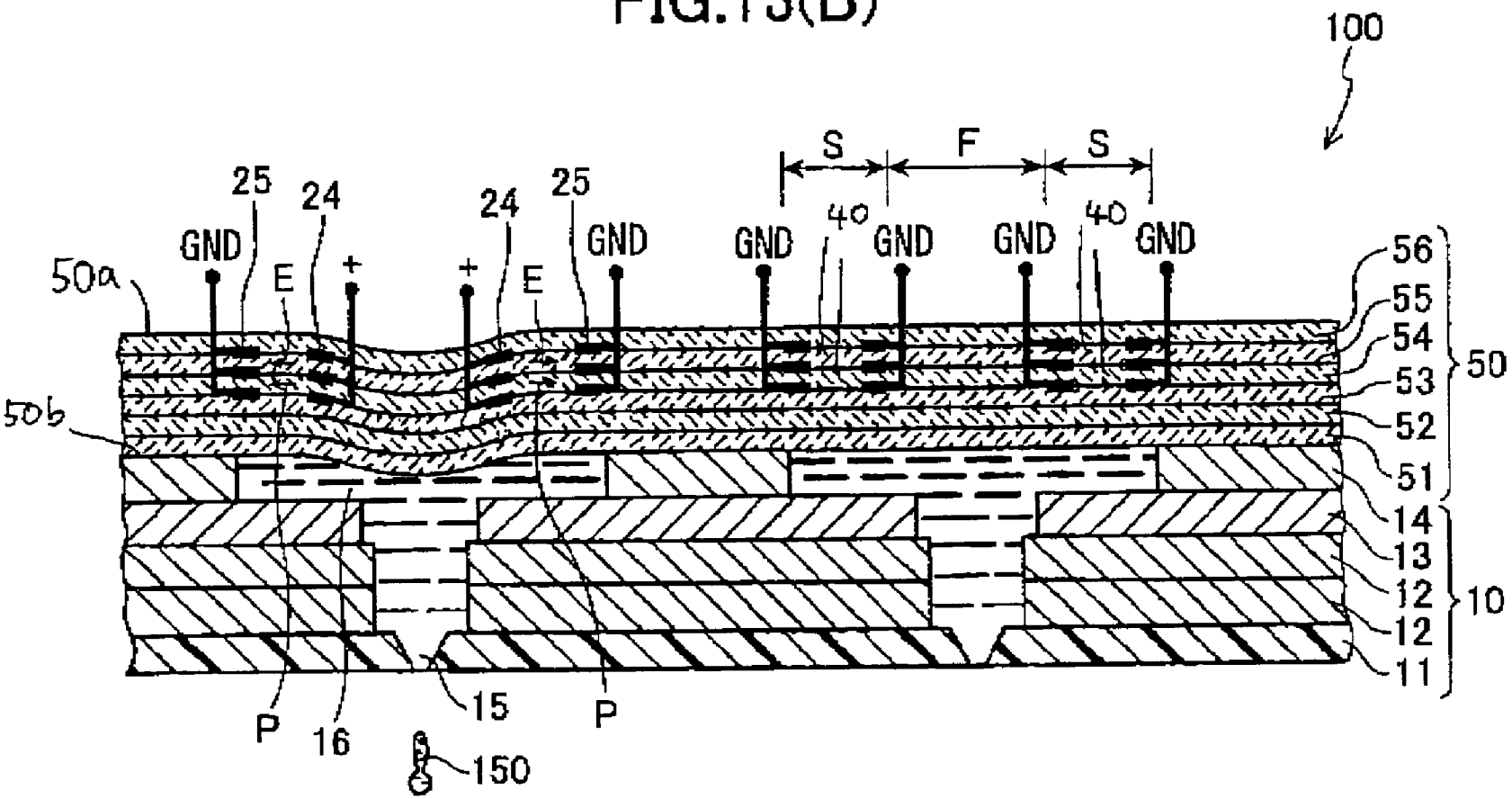
FIG. 13(B) is a partial cross-sectional view that corresponds to FIG. 7, showing an ink jet head having an piezoelectric actuator according to a modification of the second embodiment.

However, in this modification, the piezoelectric actuator 50 is formed with the electrodes 24, 25 which are located furthest away from the cavity plate 10 as shown in FIG. 13(B). That is, the electrodes 24 and 25 are disposed on the lower sides of the piezoelectric sheets 54 . 56. Portions 40 of the piezoelectric layers 54 and 55 are interposed between the electrodes 24 and 25. The portions 40 are polarized in the same manner as described for the second embodiment. Accordingly, the polarized active portions 40 are created in the piezoelectric sheets 54–55 which are located nearer to the top surface 50*a* than to the bottom surface 50*b*.

With this configuration, pressure can be applied by reducing the volume in the pressure chamber 16 from the initial state.

More specifically, when a voltage is applied to the electrodes 24 in this configuration, then the first and second portions F, S deform in the same manner as described in the second embodiment, although in the opposite direction as shown in FIG. 13(B) so that the operation portion O protrudes into the pressure chamber 16. This decreases the volume in the pressure chamber 16 to apply ejection pressure to the ink. An ink droplet 150 is ejected through the nozzle 15.

In this modification, the electrodes 24, 25 are located at the side of the second portions S that is away from the pressure chambers 16. The polarized active portions 40 between the electrodes 24, 25 are extended in the planar direction H so that the first and second portions F, S deform in a direction that reduces the volume of the pressure chamber 16. As a result, ink is efficiently ejected from the pressure chamber 16.

It is noted that the configuration of this modification can be alternatively obtained by simply turning the piezoelectric actuator 50 of the second embodiment upside down.

<Third Embodiment>

Figure 14:
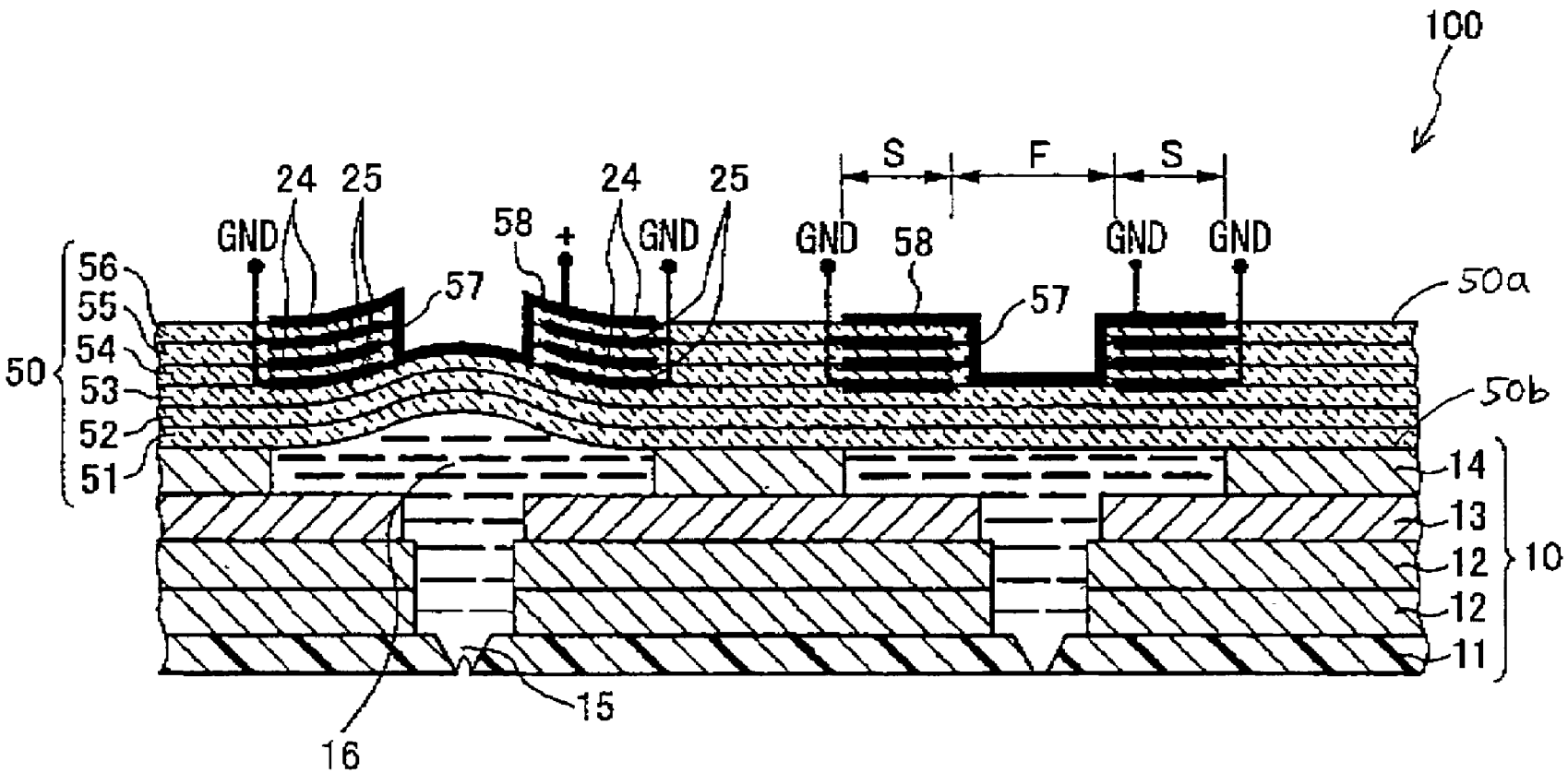
FIG. 14 is a cross-sectional view that corresponds to FIG. 7, showing an ink jet head having an piezoelectric actuator according to a third embodiment.

Next, an ink jet head 100 including a piezoelectric actuator 50 according to a third embodiment of the present invention will be described with reference to FIG. 14.

The piezoelectric actuator 50 of the present embodiment has a configuration similar to the piezoelectric actuator 50 of the first embodiment. However, a notch 57 is formed in the surface of the first portion F that is opposite from the surface adjacent to the pressure chamber 16. Said differently, the notch 57 is formed in the surface of the first portion F at a position shifted in the thickness direction of the piezoelectric actuator 50 in the direction in which the first portion F archingly protrudes. In this example, the notch 57 is formed by removing the portion of the piezoelectric sheets 54–56 in the first portion F.

A connection electrode 58 is formed, for example by deposition of a conductive material, on the inner surface of the notch 57 and on the top surface 50*a* of the piezoelectric actuator 50. Wiring that extends from either the drive electrodes 24 or the ground electrodes 25 is connected to the connection electrode 58 and to an external power source through the connection electrode 58.

In this way, the notch 57 is opened to the upper surface of the piezoelectric actuator 50 and includes at its inner surface the connection electrode 58 for supplying power to either the drive electrodes 24 or the ground electrodes 25. Therefore, wiring of the electrodes can be simply performed.

The notch 57 reduces thickness of the first portion F so that the first portion F is made from only the piezoelectric sheets 51–53 that are located near the pressure chamber 16.

As a result, the first portion F becomes less stiff than the second portions S. Accordingly, the first portion F bends under deformation of the second portions S with little resistance. The first portion F deforms greatly and the volume of the pressure chamber 16 changes greatly also.

It should be noted that instead of providing the notch 57, other configurations can be provided to enable the first portion F to deform easily. For example, the portion of the first portion F that is opposite from the pressure chamber 16 can be formed with a material that has lower stiffness than the second portions S.

Alternatively, a hollow portion can be formed in the portion of the first portion F that is opposite from the pressure chamber 16.

Because the first portion F arches and deforms more easily than the second portions S, the first portion F shows little resistance to deformation of the second portions S under operation of the second portions S and the deformation amount overall increases.

<Fourth Embodiment>

Figure 15:
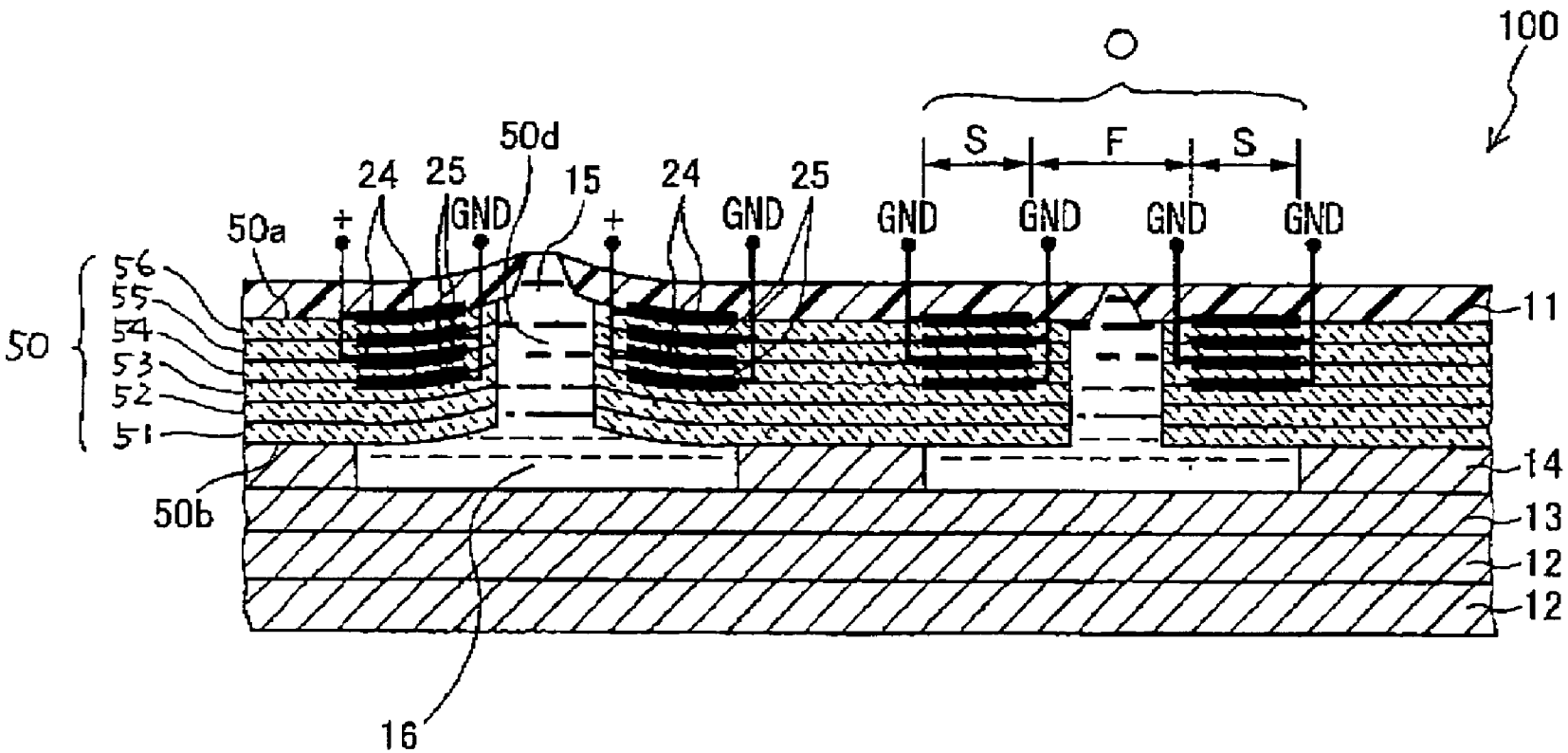
FIG. 15 is a cross-sectional view that corresponds to FIG. 7, showing an ink jet head having an piezoelectric actuator according to a fourth embodiment.

Next, an ink jet head 100 including a piezoelectric actuator 50 according to a fourth embodiment of the present invention will be described while referring to FIG. 15.

The piezoelectric actuator 50 of the present embodiment has a configuration similar to that of the piezoelectric actuator 50 of the first embodiment, except that a small-diameter through-hole 50*d* is opened through the piezoelectric sheets 51–56 at the first portion F. The nozzle plate 11 is adhered to the front surface 50*a*, which is opposite from the side of the piezoelectric actuator 50 where the pressure chambers 16 are located. Nozzles 15 are opened in the nozzle plate 11 at positions that correspond to the through-holes 50*d* in order to bring the nozzles 15 into fluid communication with corresponding pressure chambers 16.

When applied with voltage, the operation portion O deforms in the same manner as the piezoelectric actuator 50 of the first embodiment. In association with the deformation of the operation portion O, the portion of the nozzle plate 11 around the nozzle 15 also deforms as shown in FIG. 15, thereby further increasing volume of the pressure chamber 16. When the operation portion O reverts to its initial shape, then pressure is applied to the ink in the pressure chamber 16 and ink is ejected through the through-hole 50*d* and from the nozzle 15. According to the present embodiment, the configuration of the ink jet head 100 at its pressure chamber side can be simplified.

<Fifth Embodiment>

Figure 16:
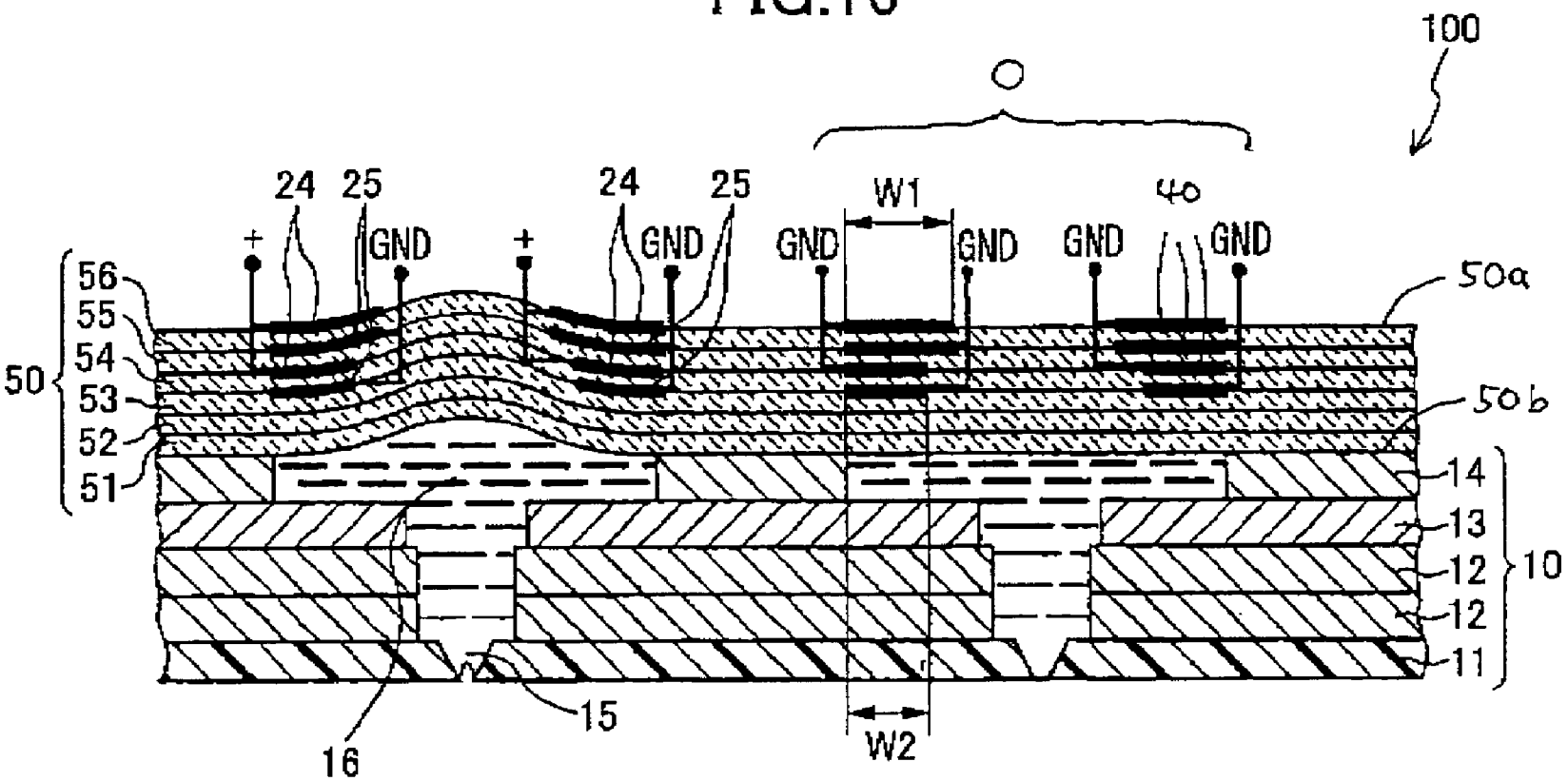
FIG. 16 is a cross-sectional view that corresponds to FIG. 7, showing an ink jet head having an piezoelectric actuator according to a fifth embodiment.

Next, an ink jet head 100 including a piezoelectric actuator 50 according to a fifth embodiment will be described with reference to FIG. 16.

The ink jet head 100 of this embodiment has configuration that same as that of the ink jet head 100 of the first embodiment, except for the width of the electrodes 24, 25. According to the first embodiment, the widths of the electrodes 24, 25 in the planar direction H are substantially equal with one another as shown in FIG. 7. Contrarily, according to the present embodiment, the nearer the electrodes 24, 25 are to the top surface 50*a* as viewed in FIG. 16, that is, to the inner side of the arc formed by the second portions S, the larger their width W in the planar direction H. Said differently, nearer the electrodes 24, 25 are to the bottom surface 50*b* as viewed in FIG. 16, that is, to the outer side of the arc formed by the second portions S, the smaller their width W in the planar direction H.

In this example, the electrodes 24 and 25 on the piezoelectric sheets 56 and 55 have width W1, while the electrodes 24 and 25 on the piezoelectric sheets 54 and 53 have width W2. The width W1 is greater than the width W2. It is noted that all the electrodes 24, 25 are disposed so that their outer edges with respect to the corresponding pressure chamber 16 are aligned with each other in the stacking direction of the piezoelectric sheets and with the edge of the corresponding partition wall 14*c* and so that their inner edges with respect to the corresponding pressure chamber 16 have a stepped configuration because of the difference in width.

The active portion 40 in the piezoelectric sheet 56 (inner side of the arching deformation) need to produce a larger amount of contraction force in the planar direction H than the active portions 40 in the piezoelectric sheets 55 and 54 (outer side of the arching deformation). It is sufficient that the active portions 40 in the piezoelectric sheets 55 and 54 produce only a small amount of contraction force in the planar direction H. Therefore, by forming the operation portion O as described above, the total surface area of the electrodes 24, 25 can be decreased without any reduction in the amount of arching deformation. The capacitance is greatly reduced and the current can be reduced.

In this way, the electrodes closer to the inner side of the arching deformation contribute to arching deformation, while the electrodes closer to the outer side of the arching deformation contribute to reduction in the capacitance. Therefore, the capacitance can be decreased while maintaining the same amount of arching deformation. Energy efficiency can be enhanced.

In the above description, two pairs of electrodes 24, 25 are provided in the actuator 50. However, only a single pair of electrodes 24 and 25 may be provided in the actuator 50. For example, the electrode 24 on the sheet 56 and the electrode 25 on the sheet 53 may be omitted from the actuator 50 of the fifth embodiment. In this case, only the electrode 25 on the sheet 55 and the electrode 24 on the sheet 54 remain in the actuator 50. Also in this case, the width W1 of the electrode 25 on the sheet 55 is greater than the width W2 of the electrode 24 on the sheet 54. In other words, nearer the electrodes are to the top surface 50*a*, that is, to the inner side of the arc formed by the second portion S, the larger their width W in the planar direction H. Accordingly, it is possible to obtain the same advantages as those obtained in the present embodiment.

<Sixth Embodiment>

Next, an ink jet head 100 with a piezoelectric actuator 50 according to a sixth embodiment will be described with reference to FIGS. 17 to 21(B).

In the above-described first through fifth embodiments, the electrodes 24 and 25 are provided only in the second portions S in each operation portion O. However, according to the sixth embodiment, the electrodes 24 and 25 are provided not only in the second portions S but also in the first portion F.

Figure 17:
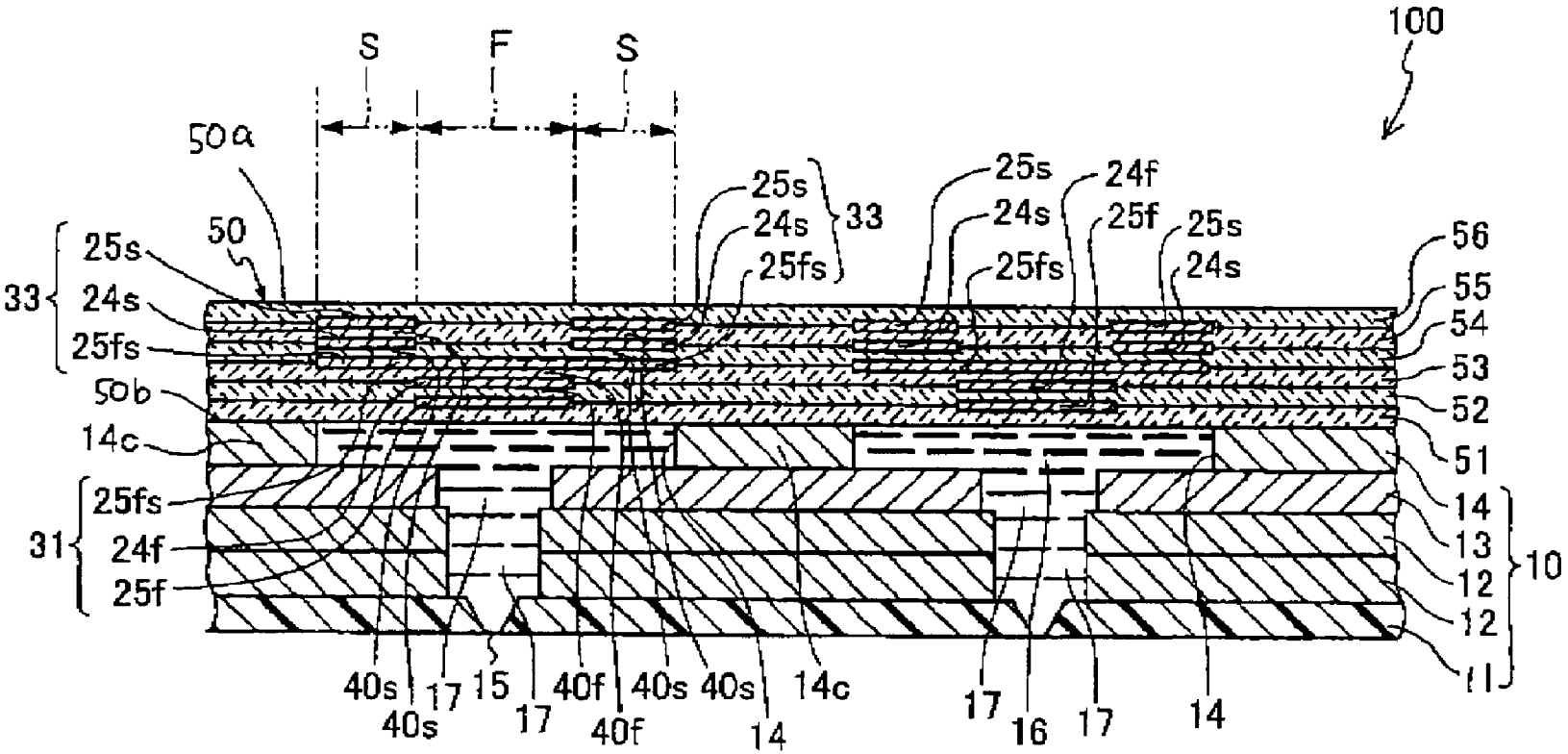
FIG. 17 is a cross-sectional view that corresponds to rig. 7, showing an ink jet head having an piezoelectric actuator according to a sixth embodiment.
Figure 18:
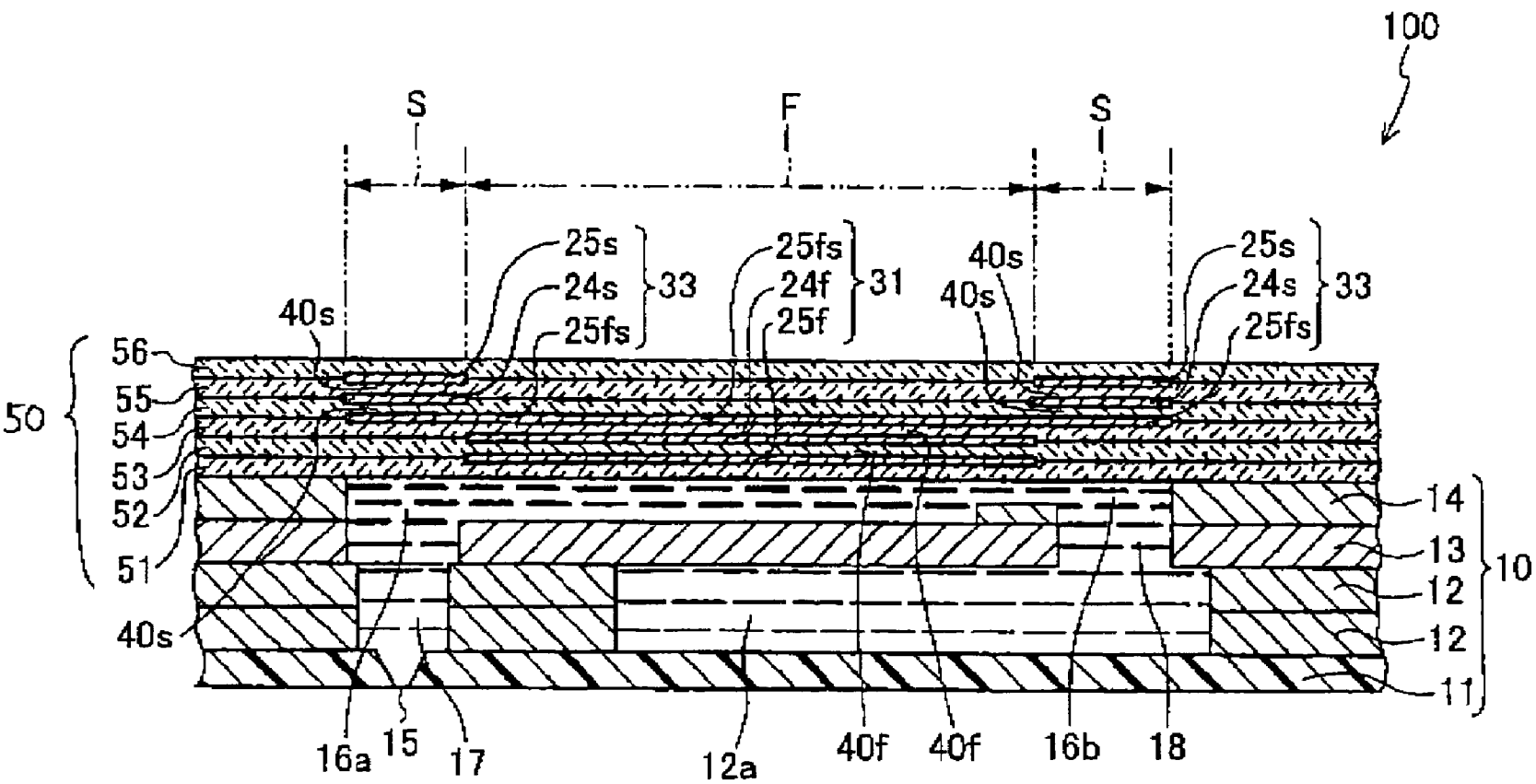
FIG. 18 is a partial cross-sectional view that corresponds to FIG. 8, showing the ink jet head according to a sixth embodiment.

More specifically, as shown in FIGS. 17 and 18, a drive electrode 24*s* is provided in the second portion S of each operation portion O at a position between the piezoelectric sheets 54 and 55. Also, a ground electrode 25*s* is provided in the second portion S at a position between the piezoelectric sheets 55 and 56. Accordingly, the electrodes 24*s*, 25*s* are in a rectangular frame shape that follows the periphery of the corresponding pressure chamber 16 in the same manner as in the first embodiment.

In the first portion F of each operation portion O, a drive electrode 24*f* is provided between the piezoelectric sheets 52, 53, and a ground electrode 25*f* is provided between the piezoelectric sheets 52, 53. Each of the electrodes 24*f*, 25*f* is in a rectangular shape that confronts the center of the corresponding pressure chamber 16. Further, a single F-S common ground electrode 25*fs* is provided in each operation portion O between the piezoelectric sheets 53 and 54 and extends entirely across the operation portion O, that is, the first portion F and the pair of second portions S. The electrode 25*fs* has a rectangular shape entirely covering the area of the corresponding pressure chamber 16.

It is noted that the electrodes 25*fs*, 24*f*, 25*f* configure a first electrode group 31 disposed in the first portion F one on top of the other in the stacking direction of the piezoelectric sheets. The electrodes 25*s*, 24*s*, 25*fs* configures a second electrode group 33 disposed in the second portion S one on top of the other in the stacking direction of the piezoelectric sheets. The F-S common ground electrode 25*fs* is provided as a common electrode shared by both of the first and second electrode groups 31, 33 because it extends across both the first and second portions F, S.

Figure 19:
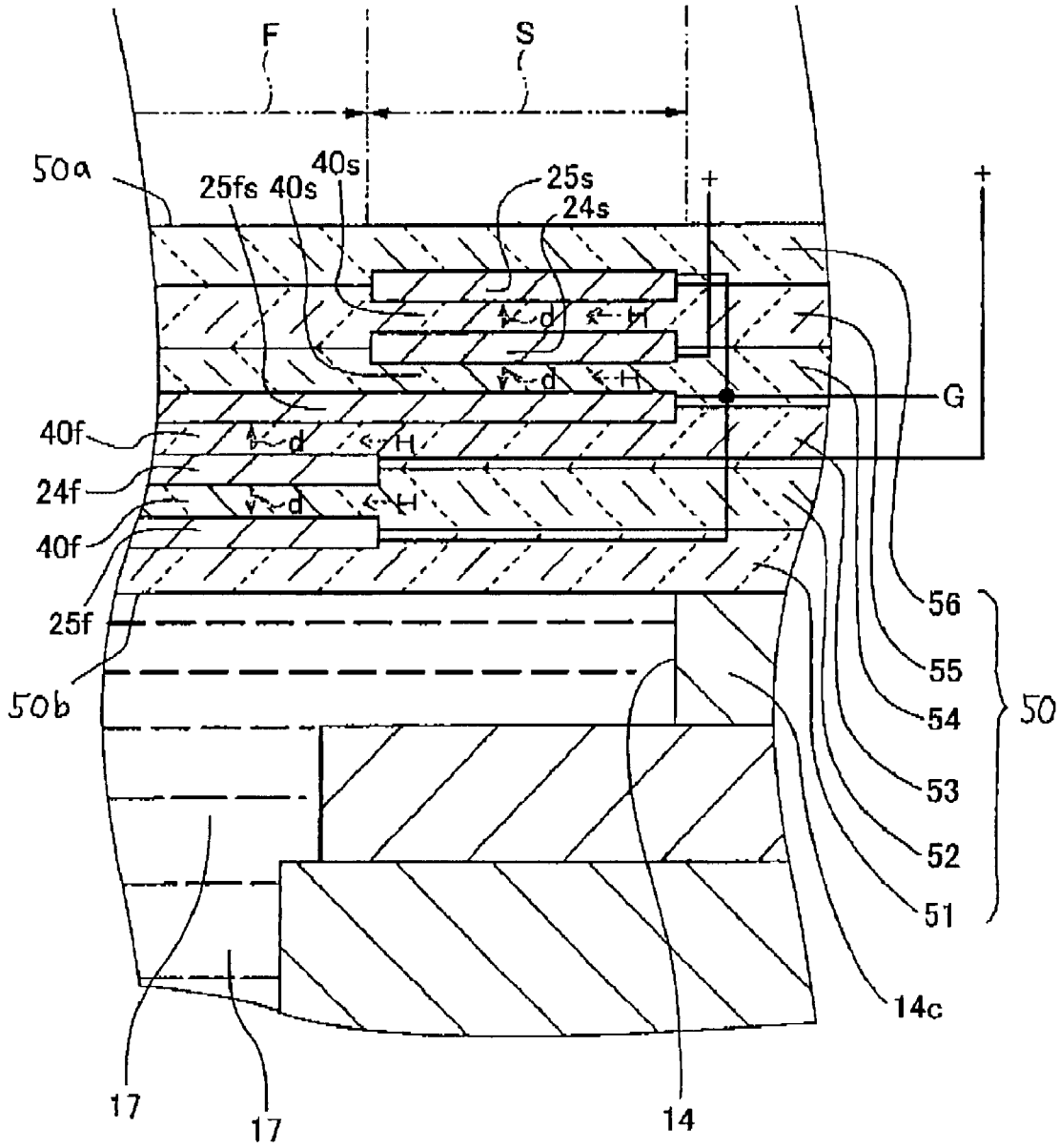
FIG. 19 is a magnified cross-sectional view showing the piezoelectric actuator and pressure chamber shown in FIG. 17.

As shown in FIG. 19, the electrodes 24*s*, 24*f* are connected to a positive power source (+), and the electrodes 25*s*, 25*fs*, 25*f* are connected to ground (G). In this way, every other one of electrodes 25*s*, 24*s*, 25*fs*, 24*f*, 25*f* is connected to the positive power source (+) and the remainder are connected to ground (G). When a high voltage is applied to the electrodes 24*s*, 24*f*, the portion 40*s* of the piezoelectric sheet 55 between the electrodes 24*s* and 25*s*, the portion 40*s* of the piezoelectric sheet 54 between the electrodes 24*s* and 25*fs*, the portion 40*f* of the piezoelectric sheet 53 between the electrodes 25*fs* and 24*f*, and the portion 40*f* of the piezoelectric sheet 52 between the electrodes 24*f* and 25*f* become polarized in a direction perpendicular to the stacking direction as indicated by arrow d in FIG. 19. The portions 40*s* of the piezoelectric sheets 54 and 55 will serve as active portions that deform when a drive voltage is applied between the electrodes 24*s* and 25*s* and 25*fs*. Also, the portions 40*f* of the piezoelectric sheets 52 and 53 will also serve as active portions that deform when applied with a drive voltage between the electrodes 24*f* and 25*f* and 25*fs*.

In this way, according to the present embodiment, in the first portion F, the polarized active portions 40*f* are provided in the piezoelectric layers 52 and 53, which are located nearer to the bottom surface 50*b* than to the upper surface 50*a*, and non-polarized inactive portions are provided in the piezoelectric layers 54 and 55, which are located nearer to the upper surface 50*a* than to the bottom surface 50*b*. In other words, in each first portion F, the active portions 40*f* are provided in the portion of nearer the pressure chamber 16, while the non-polarized inactive portions are provided at the side opposite from the pressure chamber 16.

In each second portion S, the polarized active portions 40*s* are provided in the piezoelectric layers 54 and 55, which are located nearer to the upper surface 50*a* than to the bottom surface 50*b*, and non-polarized inactive portions are provided in the piezoelectric layers 52 and 53, which are located nearer to the bottom surface 50*b* than to the upper surface 50*a*. In other words, in each second portion S, the active portions 40*s* are provided at the side opposite from the pressure chamber 16, while the non-polarized inactive portions at the side nearer the pressure chamber 16.

Figure 20:
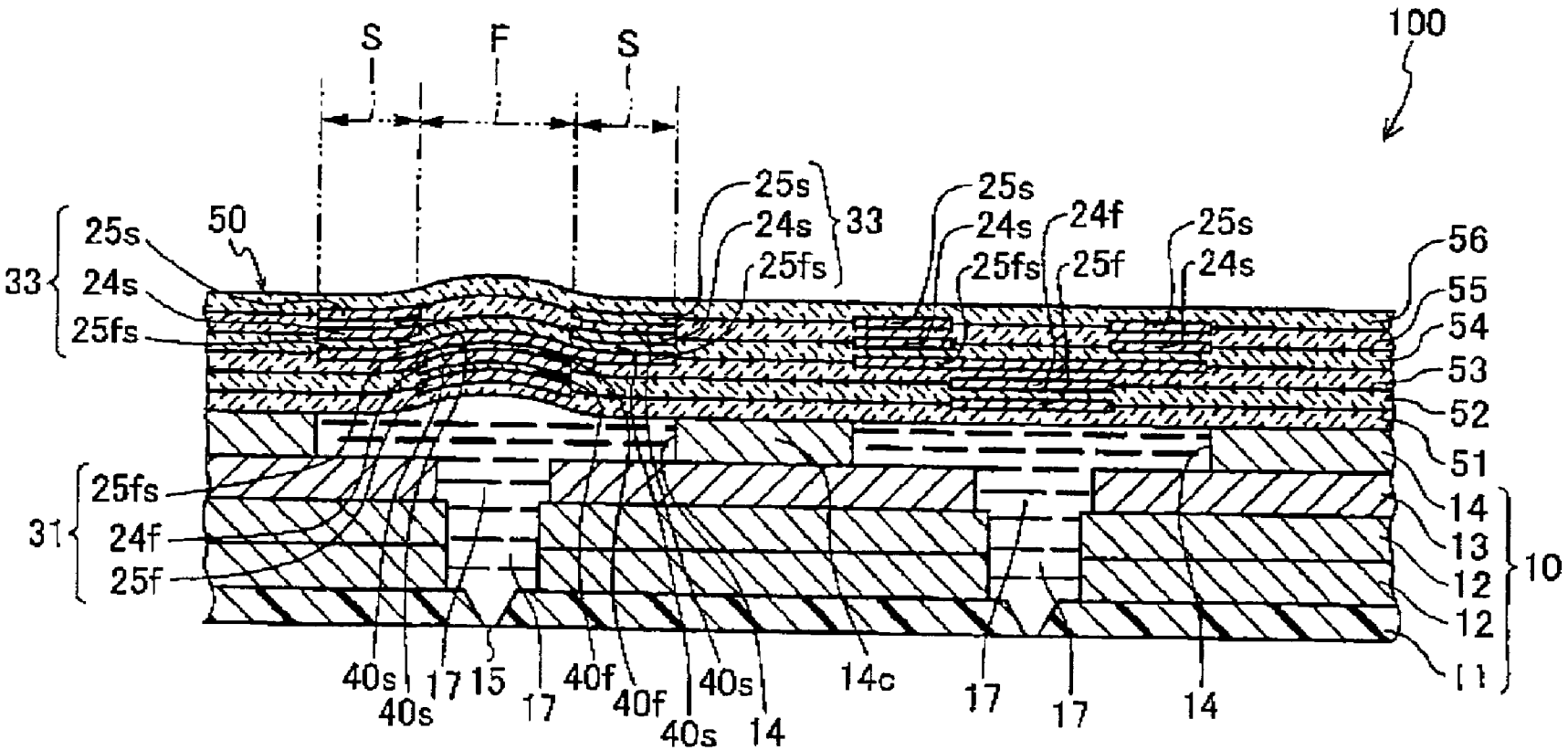
FIG. 20 is a cross-sectional view showing the piezoelectric actuator of FIG. 17 in a deformed condition.
Figure 21:
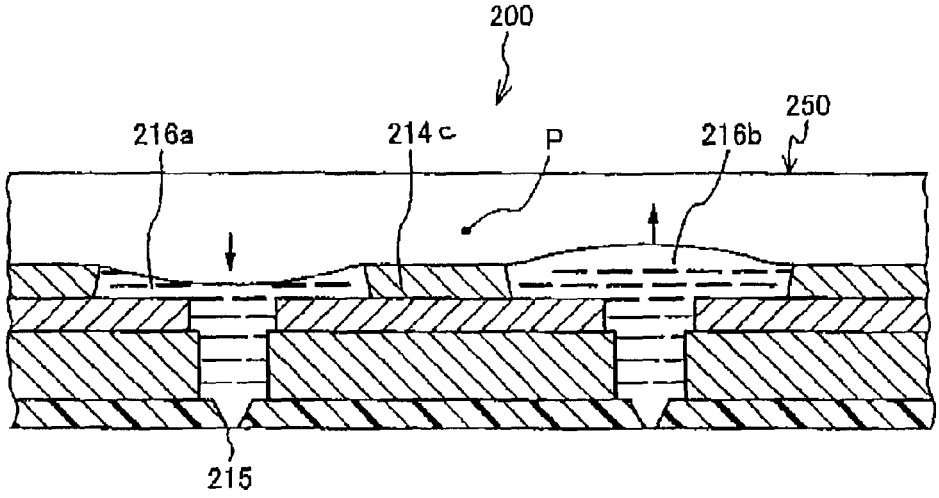
FIG. 21(A) is a cross-sectional view showing how a piezoelectric actuator of the ink jet head of FIG. 1 deforms in a deformed condition.
FIG. 21(B) is a cross-sectional view showing how a piezoelectric actuator according to a comparative example deforms in a deformed condition.
Figure 21:
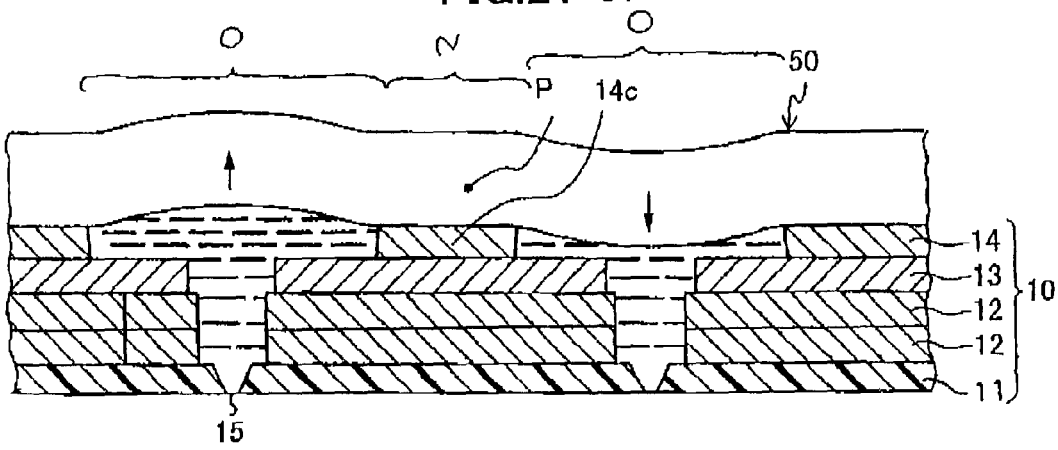

When ink is to be ejected, then in the same manner as during the polarization process, as shown in FIG. 19 the ground electrodes 25*s*, 25*fs*, 25*f* are connected to ground (G) and the drive electrodes 248, 24*f* are connected to a positive power source (+) Then, a drive voltage, whose amount is lower than the polarization voltage, is applied to the drive electrodes 24*s*, 24*f* that correspond to the pressure chamber 16 from which ink is to be ejected. As a result, an electric field that is parallel with the polarization direction d is generated in the active portions 40*f* and 40*s* so that the active portions 40*f*, 40*s* contract in a direction parallel with the planar direction H, that is, in a direction that is perpendicular to the direction in which the piezoelectric sheets are stacked. On the other hand, the inactive portions in the first and second portions F, S do not contract. Accordingly, as shown in FIG. 20, the second portions S arch to protrude downward and the first portion F arches to protrude upward. In this way, the operation portion O deforms in the direction to increase the volume of the corresponding pressure chamber 16, as a result of which ink is drawn in from the common ink chamber 12*a*. Afterward, the voltage applied to the drive electrodes 24*s*, 24*f* is stopped so that the operation portion O reverts to its initial flat condition shown in FIG. 17. This applies pressure to the ink in the pressure chamber 16 so that ink is ejected from the corresponding nozzle 15.

It should be noted that in addition to contracting, the active portions 40*f*, 40*s* also extend in the direction parallel to the polarization direction d. However, the amount of extension is only a fraction of the amount of contraction because there are only few piezoelectric ceramic layers in the stack. Therefore, the extension of the active portions 40*f*, 40*s* hardly influences the ink ejection operation at all.

It is noted that the conventional configuration shown in FIG. 1 suffers from cross talk. That is, when voltage is applied to eject ink from some pressure chamber 216*a* in the conventional ink jet head 200, the active portion 240 that corresponds to the pressure chamber 216*a* deforms to protrude downward to eject ink. As shown in FIG. 21(A), the action of the piezoelectric plate 250 protruding downward at the pressure chamber 216*a* produces an opposite reaction in the portion of the piezoelectric plate 250 above the adjacent pressure chamber 216*b*. The opposite reaction arches the piezoelectric plate 250 to protrude upward above the adjacent pressure chamber 216*b*, with the portion above the partition wall 214*c* between the pressure chambers 216 functioning as a fulcrum P. The opposite reaction also applies force to the partition wall 214*c* so that the partition wall 214*c* tilts in the direction of the pressure chamber 216*a*. In this way, the operation for electing ink from the pressure chamber 216*a* also changes the volume in the adjacent pressure chamber 216*b*. The change in volume changes the pressure in the ink in the adjacent pressure chamber 216*b*. If later the piezoelectric plate 250 is operated to eject ink from the adjacent pressure chamber 216*b*, then these changes in volume and pressure in the adjacent pressure chamber 216*b* translate into variation in the speed and volume of ejected ink droplets. For this reason, crosstalk reduces printing quality of the conventional ink jet head 200.

In the similar manner as described above, cross talk will be generated if the piezoelectric actuator 50 of the present embodiment is not provided with the electrodes 24*s*, 25*s* but is provided with the electrodes 25*f*, 24*f*, and 25*fs* only. In such a case, as shown in FIG. 21(B), application of voltage to the electrodes 25*fs*, 24*f*, 25*f* of the first portion F at one operation portion O would deform the entire portion of the operation portion O upward. As a result, the operation portion O for the adjacent pressure chamber 16 would archingly bend downward in an opposite reaction. The portion N above the partition wall 14*c* would serve as a fulcrum P. The partition wall 14*c* would tilt.

However, according to the present embodiment, the electrodes 24*s*, 25*s* are provided in the second portions S. Accordingly, as shown in FIG. 20, the second portions S at either side of the protrudingly-arching first portion F protrudingly arch in the direction opposite to the direction, in which the first portion P protrudingly arch. This substantially cancels out the opposite reaction associated with deformation of the first portion P so that influence to the operation portion O for the next pressure chamber 16 and influence to the partition wall 14*c* is suppressed. Accordingly, crosstalk to adjacent pressure chambers is reduced, speed and volume of ejected ink droplets are made substantially uniform, and printing quality is enhanced.

The first and second electrode groups 31, 33 each includes three or more electrodes 24, 25, and two or more piezoelectric sheets are interposed between the three or more electrodes 24, 25. Accordingly, when voltage is applied to the electrodes 24, 25, then an electric field is generated in the piezoelectric sheets that are between the electrodes 24, 25. As a result, two or more layers in the first and second portions F, S contract in the planar direction. Accordingly, the first portion F sufficiently deforms to protrude upward and the second portions at either side of the first portions F sufficiently deform to protrude downward in the opposite direction, so that crosstalk in the adjacent pressure chamber 16 is reduced.

Moreover, the first and second electrode groups 31, 33 each include the F-S common ground electrode 25*fs* that extends across the first portion F and the second portions S. In addition to the F-S common ground electrode 25*fs*, the first electrode group 31 includes the electrodes 24*f*, 25*f*, which confront the F-S common ground electrode 25*fs* at the first portion F, and the second electrode group 33 includes the electrodes 24*s*, 25*s*, which confront the F-S common ground electrode 25*fs* at the second portions S. With this configuration, the first portion F deforms to protrude upward and the second portions S at either side of the first portion F deform to protrude downward in the opposite direction, while the F-S common ground electrode 25*fs* serving as the boundary. As a result, it is ensured that cross talk between the adjacent pressure chambers 16 is reduced.

As described above, according to the present embodiment, when the electrodes 24*f*, 25*f*, 25*fs*, 24*s*, and 25*s* are energized, an electric field is generated in each active portion 40*f*, 40*s* sandwiched between these electrodes. As a result, the first portion F that corresponds to the center of the pressure chamber 16 archingly protrudes upwardly, and the second portion S that corresponds to the periphery of the pressure chamber 16 archingly protrudes downwardly. In this way, the first and second portions cooperate to deform the entire operation portion O in a large amount. By the second portion S protruding downwardly, it is possible to suppress an adjacent pressure chamber 16 from protruding downwardly due to the reaction of the upward protrusion of the first portion F. It is possible to reduce the crosstalk.

According to the present embodiment, the electrodes 24*s*, 25*s* are provided only in the second portions S and the electrodes 24*f*, 25*f* are provided only in the first portion F. Only the electrode 25*fs* is provided both in the first and second portions S. Thus, similarly to the first through fifth embodiments, the piezoelectric actuator 50 of the present embodiment attains high energy efficiency because only a small surface area of the piezoelectric layers is positioned between the electrodes. The piezoelectric actuator 50 of the present embodiment also enables deformation of the portion of the actuator that corresponds to one pressure chamber without influencing the portion of the actuator that corresponds to the other pressure chambers, thereby achieving high print quality.

Because the F-S common ground electrode 25*fs* is shared by both the first and second portions F, S, the electrode arrangement is made simple.

<Modification>

Next, a modification of the sixth embodiment will be described with reference to FIGS. 22(A), 22(B).

Also in this modification, the electrode 24*fs* spans across the first portion F and the second portions S and are disposed between the piezoelectric sheets 53, 54 in the same manner as in the sixth embodiment. However, according to this modification, the electrodes 24*s*, 25*s* of the second portion S are disposed between the piezoelectric sheets 51–53, which are nearer to the pressure chamber 16 of the piezoelectric actuator 50. Further, the electrodes 24*f*, 25*f* of the first portion F are positioned between the piezoelectric sheets 54–56, which are to the opposite side of the piezoelectric actuator 50 than the pressure chamber 16.

Portions 40*f* of the piezoelectric layers 54 and 55 are interposed between the electrodes 25*fs*, 24*f*, 25*f* at the first portion F. Portions 40*s* of the piezoelectric layers 52 and 53 are interposed between the electrodes 25*fs*, 24*s*, 25*s*. The portions 40*f*, 40*s* are polarized in the same manner as described for the sixth embodiment.

According to the present modification, therefore, in the first portion F, the polarized active portions 40*f* are provided in the piezoelectric layers 54 and 55, which are located nearer to the upper surface 50*a* than to the bottom surface 50*b*, and non-polarized inactive portions are provided in the piezoelectric layers 52 and 53, which are located nearer to the bottom surface 50*b* than to the upper surface 50*a*. In other words, in the first portion F, the active portions 40*f* are provided at the side opposite from the pressure chamber 16, while the non-polarized inactive portions are provided in the portion of nearer the pressure chamber 16. In each second portion S, the polarized active portions 40*s* are provided in the piezoelectric layers 52 and 53, which are located nearer to the bottom surface 50*b* than to the upper surface 50*a*, and non-polarized inactive portions are provided in the piezoelectric layers 54 and 55, which are located nearer to the upper surface 50*a* than to the bottom surface 50*b*. In other words, in the second portion F, the active portions 40*s* are provided in the portion of nearer the pressure chamber 16, while the non-polarized inactive portions are provided at the side opposite from the pressure chamber 16.

In the sixth embodiment, the volume in the pressure chamber 16 is first increased and then returned to the initial state, thereby applying pressure to the ink in the pressure chamber 16. However, according to the present modification, pressure can be applied by reducing the volume in the pressure chamber 16 directly from the initial state.

Figure 22A:
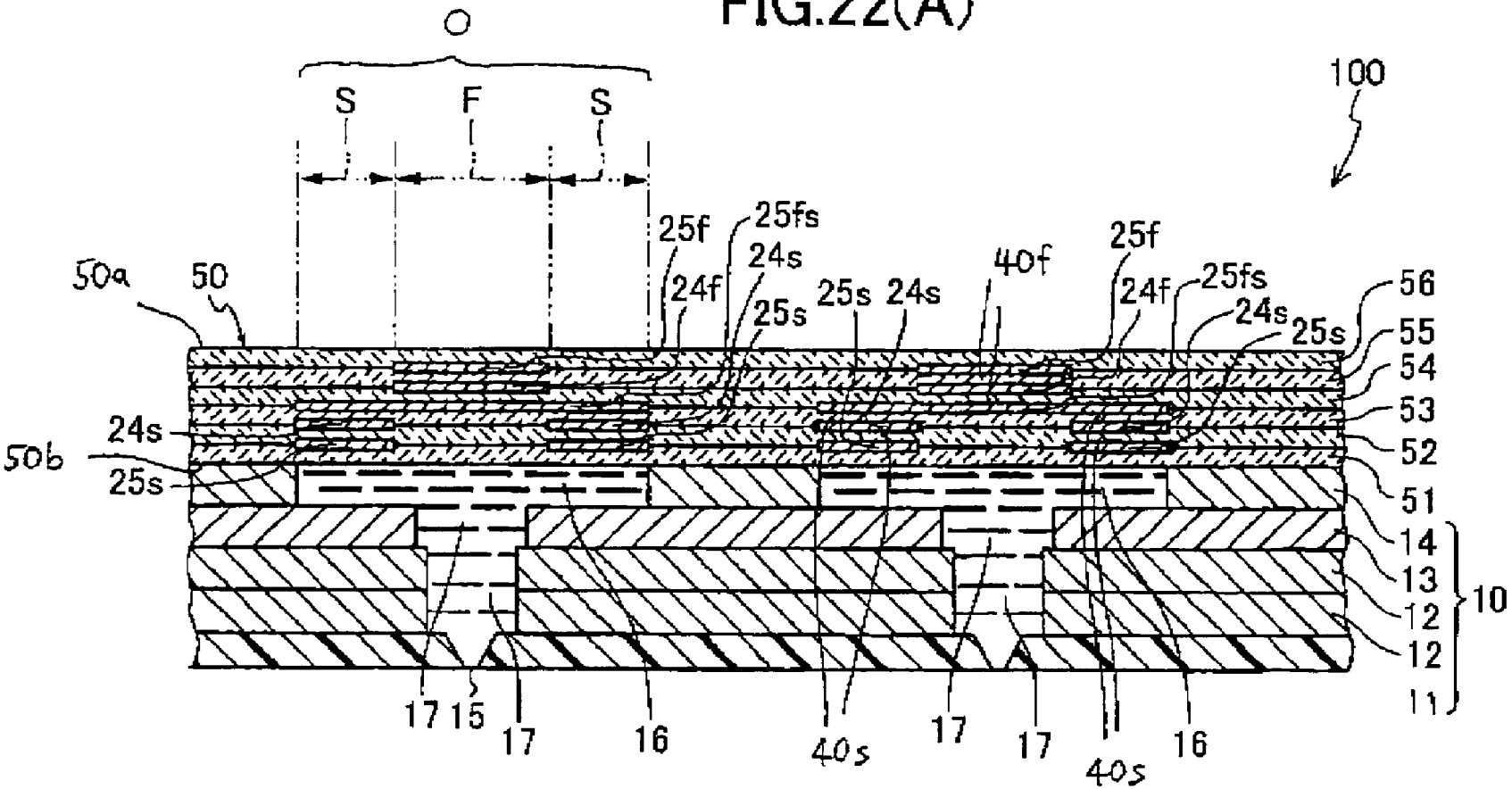
FIG. 22(A) is a partial cross-sectional view that corresponds to FIG. 7, showing a modification of the piezoelectric actuator of the sixth embodiment.
Figure 22B:
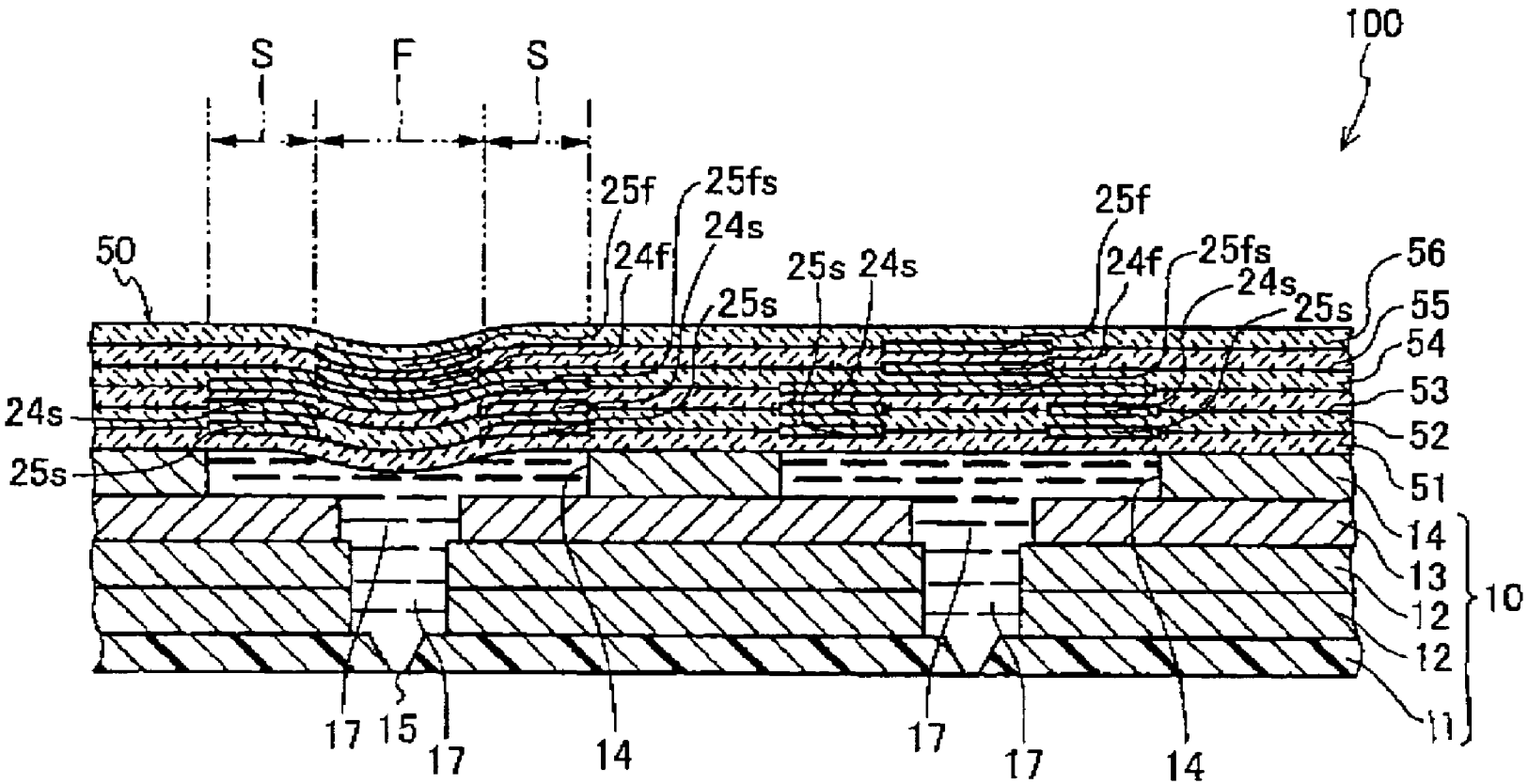
FIG. 22(B) is a cross-sectional view showing the piezoelectric actuator of FIG. 22(A) in a deformed condition.

More specifically, when a voltage is applied to the drive electrodes 24*s*, 24*f*, as shown in FIG. 22(B), the first and second portions F, S deform in the opposite direction as in the sixth embodiment so that the operation portion O deforms to decrease the volume of the pressure chamber 16 and applies ejection pressure to the ink. Ink is ejected through the nozzle 15.

It is noted that the configuration of the modification can be obtained by simply turning upside down the piezoelectric actuator 50 of the sixth embodiment.

<Seventh Embodiment>

Figure 23:
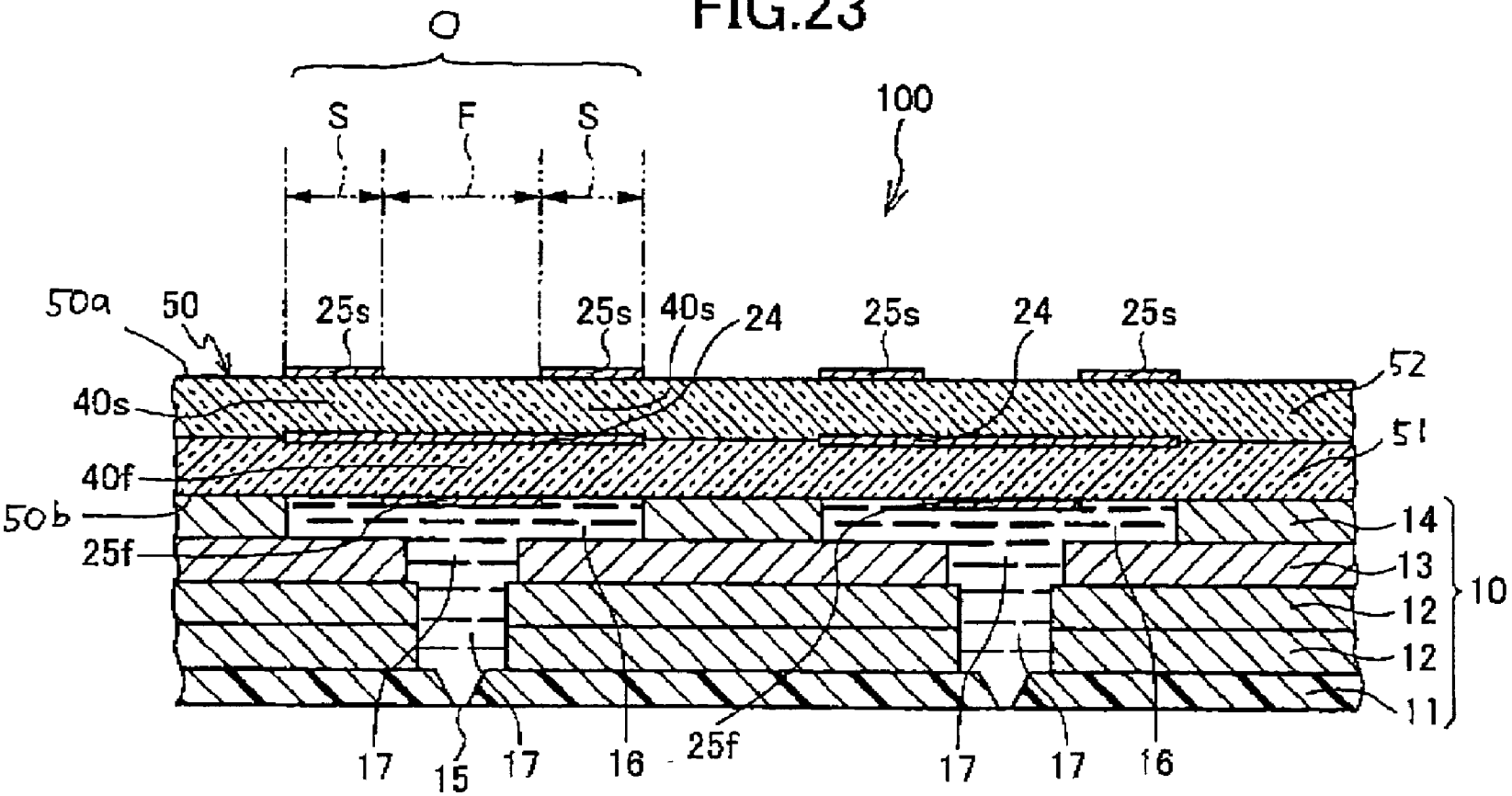
FIG. 23 is a partial cross-sectional view that corresponds to FIG. 7, showing an ink jet head having an piezoelectric actuator according to a seventh embodiment of the present invention.

Next, a piezoelectric actuator 50 according to a seventh embodiment will be described with reference to FIG. 23.

According to the seventh embodiment, the piezoelectric actuator 50 is configured from only two layers of piezoelectric sheets 51 and 52. In each operation portion O, a drive electrode 24 is disposed to span across the entire operation portion O, that is, the first and second portions F, S. In the first portion F, a ground electrode 25*f* is formed on the bottom surface 50*b* of the piezoelectric sheet 51 at a position that confronts the substantial center of the drive electrode 24. Thus, the ground electrode 25*f* is a rectangular shape that confronts the substantial center of the pressure chamber 16 In the second portion S, a ground electrode 25*s* is formed on the top surface 50*a* of the piezoelectric sheet 52, that is, at the side of the second portion S farthest from the pressure chamber 16. The ground electrode 25*s* is a rectangular frame shape that is located at a position confronting the peripheral portion of the drive electrode 24, that is, the peripheral portion of the pressure chamber 16.

A portion 40*f* of the piezoelectric sheet 51 is interposed between the ground electrode 25*f* and the drive electrode 24 at the first portion F. Portions 40*s* of the piezoelectric sheet 52 are interposed between the ground electrodes 25*s* and the drive electrode 24. The portions 40*f*, 40*s* are polarized in the same manner as described for the sixth embodiment.

According to the present embodiment, therefore, in the first portion F, the polarized active portion 40*f* is provided in the piezoelectric layer 51, which is located nearer to the bottom surface 50*b* than to the upper surface 50*a*, and a non-polarized inactive portion is provided in the piezoelectric layer 52, which is located nearer to the upper surface 50*a* than to the bottom surface 50*b*. In other words, in the first portion F, the active portion 40*f* is provided in the portion of nearer the pressure chamber 16, while the non-polarized inactive portion is provided at the side opposite from the pressure chamber 16. In each second portion S, the polarized active portion 40*s* is provided in the piezoelectric layer 52, which is located nearer to the upper surface 50*a* than to the bottom surface 50*b*, and a non-polarized inactive portion is provided in the piezoelectric layer 51, which is located nearer to the bottom surface 50*b* than to the upper surface 50*a*. In other words, in the second portion F, the active portion 40*s* is provided at the side opposite from the pressure chamber 16, while the non-polarized inactive portion is provided in the portion of nearer the pressure chamber 16.

By applying a drive voltage between the ground electrodes 25*s* and the drive electrode 24 and between the ground electrode 25*f* and the drive electrode 24, the portions 40*f*, 40*s* interposed between these electrodes contract in the direction perpendicular to the direction in which the piezoelectric sheets 51, 52 are stacked, while the non-polarized portions not interposed between electrodes do not contract.

In the same manner as in the sixth embodiment, the first portion F arches to protrude upward while at the same time the second portions S on either side of the first portion F arch to protrude in the opposite direction. Accordingly, the operation portion O deforms to increase volume of the pressure chamber 16 and then reverts to its initial condition, ejecting ink as a result.

It is noted that in the same manner as the modification of the sixth embodiment, the piezoelectric actuator 50 of the seventh embodiment can be modified upside down so a configuration that reduces volume of the pressure chamber 16 to eject ink.

While the invention has been described in detail with reference to the specific embodiments thereof, it would be apparent to those skilled in the art that various changes and modification may be made therein without departing from the spirit of the invention.

For example, in the sixth embodiment (FIG. 17), the F-S common ground electrode 25*fs* is provided as a shared electrode that extends across all of the first and second portions F, S. However, as shown in FIG. 24(A), the F-S common ground electrode 25*fs* can be divided into a ground electrode 25*f* provided to the first portion F and a pair of ground electrodes 25*s* provided to the pair of second portions S.

Figure 24A:
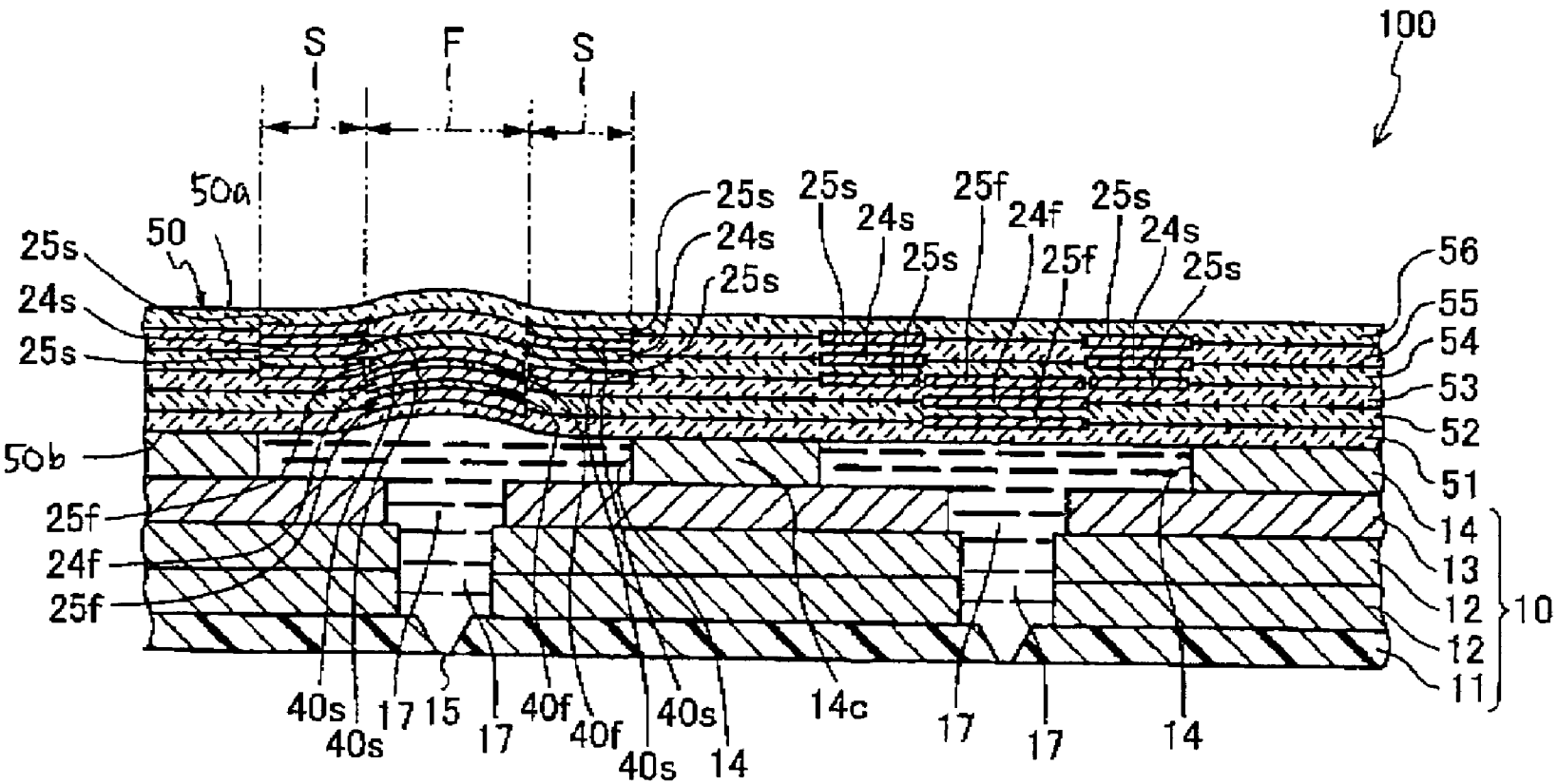
FIG. 24(A) is a partial cross-sectional view that corresponds to FIG. 7, showing an ink jet head having an piezoelectric actuator according to a modification.

It is noted that this configuration of FIG. 24(A) is similar to the configuration obtained simply by adding, to the configuration of the first embodiment (FIGS. 10 and 11), an additional group of electrodes 24 and 25 in the first portion F. The additional group of electrodes 24 and 25 are provided in the first portion F at the side nearer to the bottom surface 50*b* than to the upper surface 50*a*, while the original group of electrodes 24 and 25 are provided in the second portions S at the side nearer to the upper surface 50*a* than to the bottom surface 50*b*.

Similarly, in the modification of the sixth embodiment (FIG. 22(A)), the F-S common ground electrode 25*fs* is provided as a shared electrode that extends across all of the first and second portions F, S. However, as shown in FIG. 24(B), the F-S common ground electrode 25*fs* can be divided into a ground electrode 25*f* provided to the first portion F and a pair of ground electrodes 25*s* provided to the pair of second portions S.

Figure 24B:
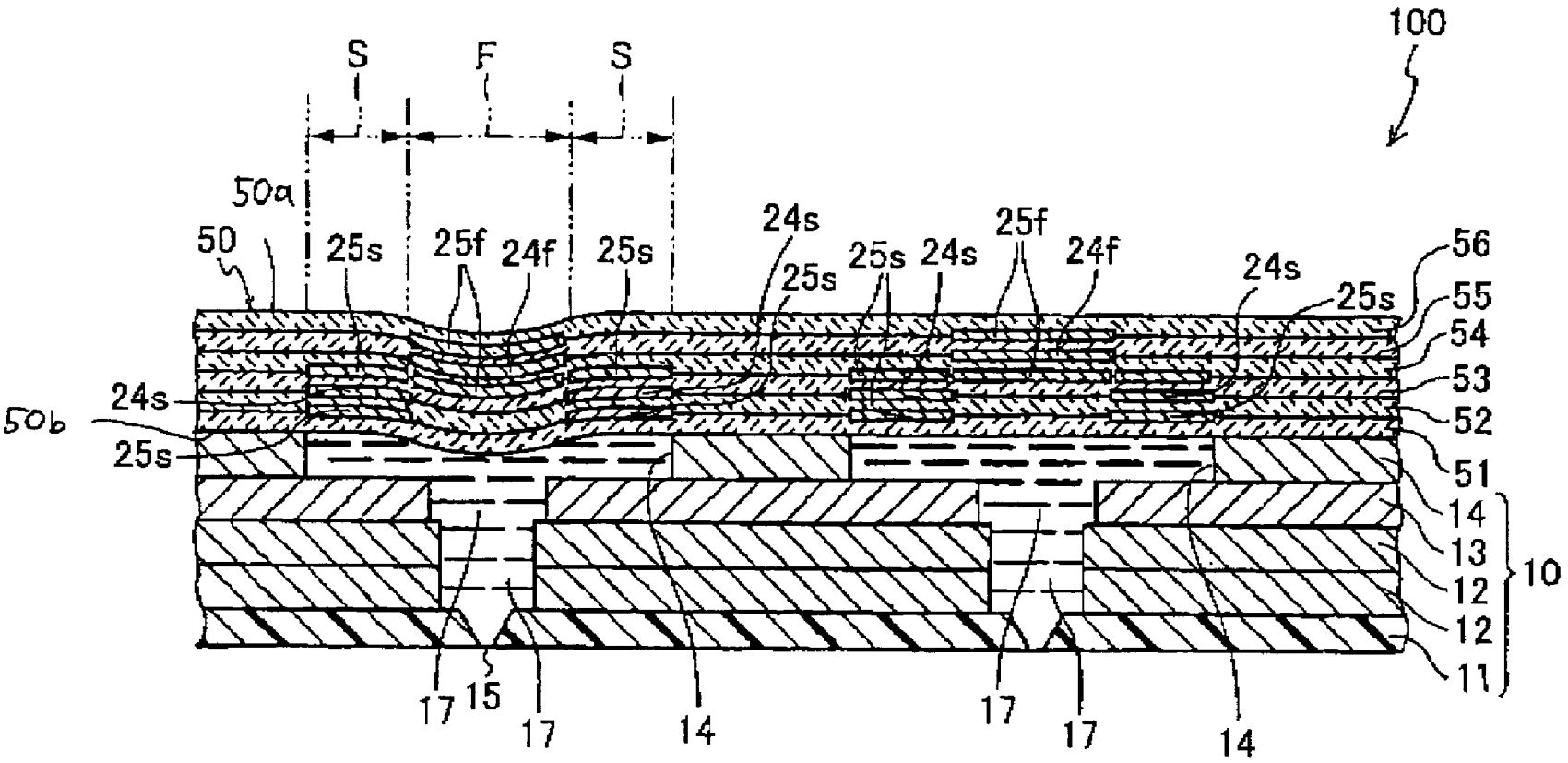
FIG. 24(B) is a partial cross-sectional view that corresponds to FIG. 7, showing an ink jet head having an piezoelectric actuator according to another modification.

It is noted that this configuration of FIG. 24(B) is similar to the configuration obtained simply by adding, to the configuration of the modification of the first embodiment (FIGS. 12(A) and 12(B)), an additional group of electrodes 24 and 25 in the first portion F. The additional group of electrodes 24 and 25 are provided in the first portion F at the side nearer to the upper surface 50*a* than to the bottom surface 50*b*, while the original group of electrodes 24 and 25 are provided in the second portions S at the side nearer to the bottom surface 50*b* than to the upper surface 50*a*.

Figure 25:
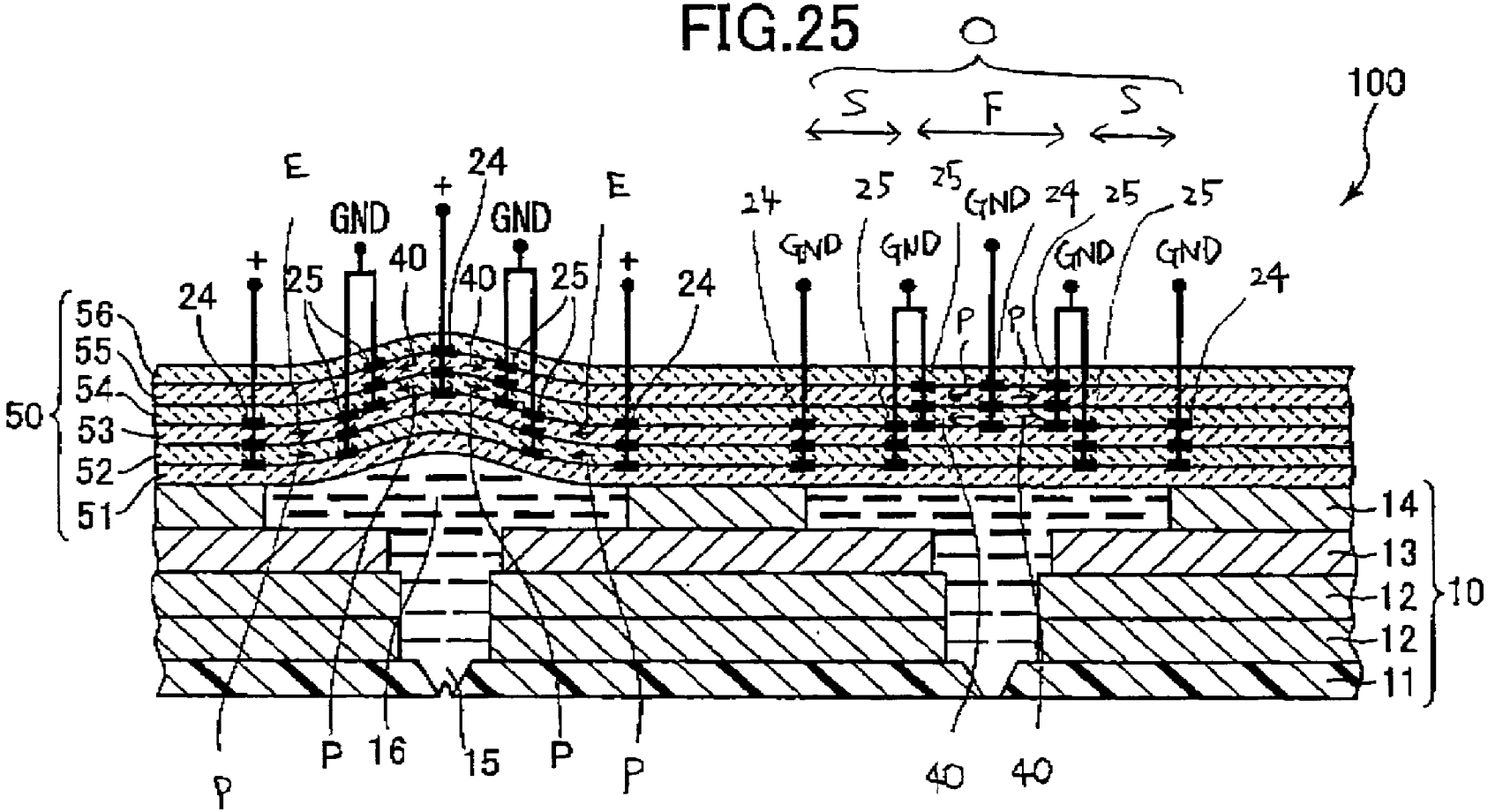
FIG. 25 is a partial cross-sectional view that corresponds to FIG. 7, showing an ink jet head having an piezoelectric actuator according to another modification.

The configuration of the second embodiment (FIG. 13(A)) can be modified similarly as described above. That is, the configuration of the second embodiment can be modified, as shown in FIG. 25, by adding an additional electrode group of electrodes 24 and 25 on each of the upper sides of the piezoelectric sheets 53–55 in the first portion F.

The additional electrode group includes: a drive electrode 24 of a single line shape, and a ground electrode 25 of a rectangular frame shape that surrounds the drive electrode 24. Accordingly, a pair of additional active portions 40 are formed in the first portion F in each of the piezoelectric sheets 54 and 55 at locations between the electrodes 24 and 25. The additional active portions 40 are polarized in a direction P from the inner-side drive electrode 24 to the outer-side ground electrode 25 by applying a high, positive voltage to the drive electrode 24 and connecting the ground electrode 25 to ground.

It is noted that in the second embodiment of FIG. 13(A), in the second portion S, the inner-side electrodes serve as drive electrodes 24 and the outer-side electrodes serve as ground electrodes 25. However, in this modification, in the second portion S, the inner-side electrodes serve as ground electrodes 25 and the outer-side electrodes serve as drive electrodes 24.

The configuration of the modification of the second embodiment (FIG. 13(B)) can be modified in the same manner as described above by adding an additional electrode group of electrodes 24 and 25 in the first portion F.

In the first and third through seventh embodiments described above, an electric field is generated in the active portions 40 in the same direction that the active portions 40 are polarized, in order to extend the piezoelectric material in its thickness direction and therefore to contract the piezoelectric material in the planar direction, thereby increasing volume of the pressure chamber. However, an electric field can be applied in the direction opposite from the direction of polarization in order to contract the piezoelectric material in its thickness direction and therefore to extend the piezoelectric material in the planar direction. In this case, it is possible to reduce volume of the pressure chamber, as in the modifications of the first and seventh embodiments, even without changing the arrangement of the electrodes.

Similarly, in the second embodiment described above, an electric field is generated in the same direction in which the active portion 40 is polarized, in order to extend the piezoelectric material in the planar direction, thereby increasing the volume of the pressure chamber. However, an electric field can be generated in the opposite direction in which the active portion 40 is polarized, in order to contract the piezoelectric material in the planar direction. It is possible to reduce volume of the pressure chamber, as in the modification of the second embodiment, even without changing the arrangement of the electrodes.

In the first, second, and sixth embodiments described above, volume of a pressure chamber is first increased and is then reverted to the initial volume in order to apply pressure to the ink. In the modifications of the first, second, and sixth embodiments, pressure is applied to the ink by directly decreasing the volume of the pressure chamber. In the third to fifth and seventh embodiments, the volume of a pressure chamber is first increased and is then reverted to the initial volume in order to apply pressure to the ink. In the same manner as in the modifications of the first, second, and sixth embodiments, volume can be decreased to eject ink by changing the arrangement of the electrodes in the third to fifth and seventh embodiments. For example, in the third to fifth embodiments, the electrodes 24, 25 may be provided on the lower surfaces of the plates 51–54. In this case, the widths of the electrodes 24, 25 may be set so that nearer the electrodes 24, 25 are to the bottom surface 50*b*, that is, to the inner side of the arc formed by the second portion S, the larger their width W in the planar direction H. Especially, in the modification of the fifth embodiment, only a single pair of electrodes 24, 25 may be provided in the actuator 50 so that one is on the lower surface of the plate 52 and the other is on the lower surface of the plate 53. Also in this case, the widths of the electrodes 24, 25 may be set so that nearer the electrodes 24, 25 are to the bottom surface 50*b*, the larger their width W in the planar direction H. In the seventh embodiment, the electrodes 25*s* may be provided on the plate 51, while the electrode 25*f* is provided on the plate 52. Alternatively, it is possible to change the electrode arrangement simply by turning the piezoelectric actuator 50 upside down with respect to the cavity plate 10.

In the first through fifth embodiments described above, the electrodes 24 and 25 are formed in a rectangular frame shape. However, the electrodes 24 and 25 need not be formed in a rectangular frame shape. For example, the electrodes 24 and 25 may be formed in various shapes, such as a circular frame shape. The electrodes 24 and 25 could be provided simply as two parallel lines. One of the drive electrodes 24 and the ground electrodes 25 can be provided in a planar shape that covers the entire surface of the corresponding piezoelectric sheet. In the sixth to seventh embodiments, the electrodes 24*s* and 25*s* are formed in a rectangular frame shape, and the electrodes 24*f*, 25*f*, and 25*fs* are in a rectangular shape. However, the electrodes 24*s*, 25*s*, 24*t*, 25*f*, and 25*fs* may be formed in various shapes similarly as described above.

In the above-described embodiments, the first portion F is in the rectangular shape, and the pair of second portion S are connected together in an encompassing rectangular-frame shape surrounding the first portion F. However, the first portion F and the pair of second portion S may be modified into various shapes as long as the pair of second portions are disposed symmetrically on either side of the first portion. For example, the first portion may be formed from a single line and the pair of second portions may be formed from two parallel lines disposed symmetrically on either side of the first line.

The number and the positions of the electrodes 24, 24*s*, 24*f*, 25, 25*s*, 25*f*, and 25*fs* are not limited to those described in the embodiments. For example, in the first through fifth embodiments, the positions of the electrodes 24 may be interchanged with the positions of the electrodes 25. In the sixth and seventh embodiments, the positions of the electrodes 24*s* may be interchanged with the positions of the electrodes 25*s* and the positions of the electrodes 24*f* may be interchanged with the positions of the electrodes 25*f*. In this case, the electrode 25*fs* is used as an individual electrode to be applied with a driving voltage.

In the above-described embodiments, the operation portion O is archingly deformed at a position substantially in the center of the pressure chamber 16. However, the operation portion O can be archingly deformed at any position that applies a sufficient amount of pressure to the ink in the ink chamber 16.

In the above-described embodiments, the common ink chamber 12*a* is formed by two manifold plates 12. However, the common ink chamber 12*a* can be formed in a single manifold plate 12 instead. The flow regulating portions 16*d* need not be provided.

The piezoelectric actuator of the present invention can be used with any device for transporting fluid, and is not limited to use with an ink jet head.

In the above-described first through fifth embodiments, the electrodes 24, 25 are arranged in at least the second portions S to define an active portion 40 at one side near to or opposite from the pressure chamber 16 so as to bend at least the second portions S in an arch curve shape in one direction to cause the first portion F to bend in an arch curve shape in the other direction. In the sixth and seventh embodiments, the electrodes 24, 25 are arranged in the second portions S to define an active portion 40 at one side near to or opposite from the pressure chamber 16, and the electrodes 24, 25 are arranged in the first portion F to define an active portion 40 at the other side opposite from or near to the pressure chamber 16 so as to bend the second portions S in an arch curve shape in one direction while bending the first portion F in an arch curve shape in the other direction. However, the present invention is not limited to the above-described arrangement, but can be modified in various manners as long as electrodes are arranged in at least the second portions S to define an active portion 40 at one side near to or opposite from the pressure chamber so as to let at least the second portions to bend in some arbitrary shape in one direction, thereby causing the first portion F to bend in some arbitrary shape in the other direction.

In the above-described first through fifth embodiments, all the plates 51–56 constituting the actuator SO are formed from piezoelectric material. However, when the active portions 40 are provided in the plates 54–56 as shown in FIGS. 10, 13(B), 14–16, for example, the plates 51–53 may be formed from material other than piezoelectric material. For example, the plates 51–53 may be formed from metal, ceramic, resin, or the like.

Similarly, when the active portions 40 are provided in the plates 51–53 as shown in FIGS. 12(A), 13(A), for example, the plates 54–56 may be formed from material other than piezoelectric material. The plates 54–56 may be formed from material other than piezoelectric material also in the modifications of the third-fifth embodiments, wherein the electrodes 24, 25 are formed on the plates 51–53. For example, the plates 54–56 may be formed from metal, ceramic, resin, or the like.

Figure 26A:
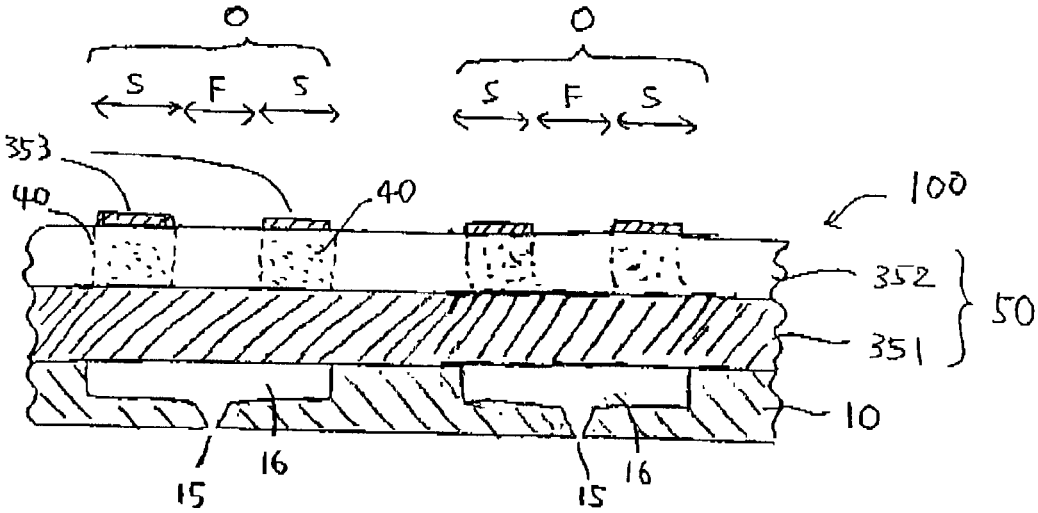
FIG. 26(A) is a partial cross-sectional view that corresponds to FIG. 7, illustrating an ink jet head having an piezoelectric actuator according to another modification.

Additionally, as shown in FIG. 26(A), the actuator 50 may be formed from a metal layer 351 and a piezoelectric layer 352. A plurality of operation portions O are provided in the piezoelectric layer 352 in one-to-one correspondence with the pressure chambers 16. In each second portion S in each operation portion O, an electrode 353 is provided over the piezoelectric layer 352. An active portion 40 is formed between the electrode 353 and the metal layer 351 when a high, polarizing voltage is applied between the electrode 353 and the metal layer 351 it is noted that in this modification, the cavity plate 10 is attached to the metal layer 351 side. However, the cavity plate 10 may be attached to the piezoelectric layer 352 side.

Figure 26B:
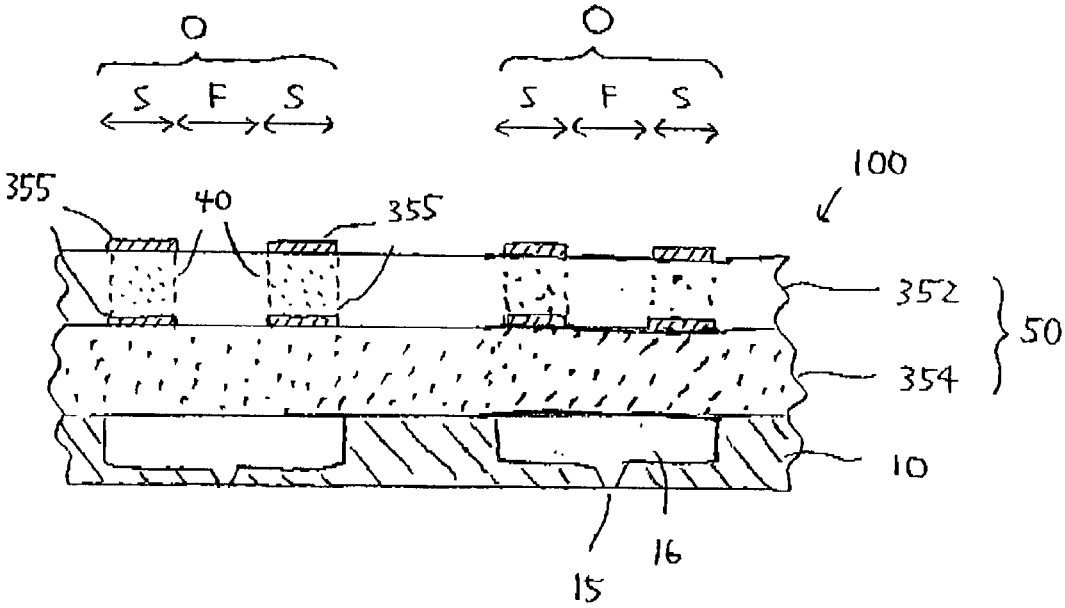
FIG. 26(B) is a partial cross-sectional view that corresponds to FIG. 7, illustrating an ink jet head having an piezoelectric actuator according to another modification.

Similarly, as shown in FIG. 26(B), the actuator 50 may be formed from a ceramic or resin layer 354 and the piezoelectric layer 352. The ceramic or resin layer 354 is made of ceramic or resin. A plurality of operation portions o are provided in the piezoelectric layer 352 in one-to-one correspondence with the pressure chambers 16. In each second portion S in each operation portion O, a pair of electrodes 355 are provided, one being over the piezoelectric layer 352 and the other being over the ceramic or resin layer 354. An active portion 40 is formed between the pair of electrodes 355 when a high, polarizing voltage is applied between the electrodes 355. It is noted that the cavity plate 10 is attached to the ceramic or resin layer 354 side. However, the cavity plate 10 may be attached to the piezoelectric layer 352 side.

Figure 27A:
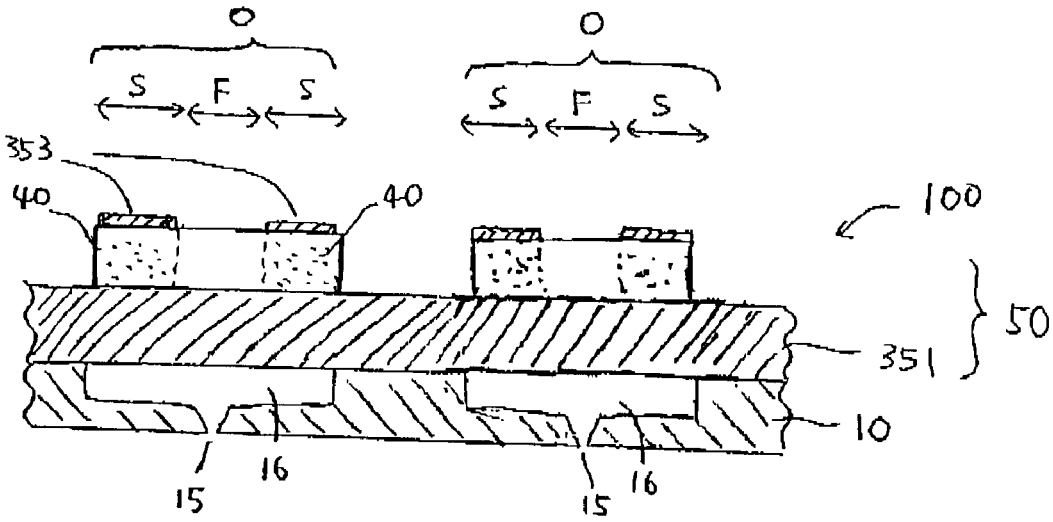
FIG. 27(A) is a partial cross-sectional view that corresponds to FIG. 7, illustrating an ink jet head having an piezoelectric actuator according to another modification.

In the above-described modification of FIG. 26(A), the plurality of operation portions O are formed in the single piezoelectric layer 352. However, as shown in FIG. 27(A), a plurality of operation portions O, each being made of piezoelectric material, may be formed individually from one another. The plurality of piezoelectric operation portions O are arranged in the planar direction over the metal layer 351 separately from one another in the planar direction. The electrode 353 is provided over each second portion S in each operation portion O to provide an active portion 40 between the electrode 353 and the metal layer 351. The cavity plate 10 is attached to the metal layer 351 side. The cavity plate 10 may be attached to the upper sides of the plurality of piezoelectric operation portions O.

Figure 27B:
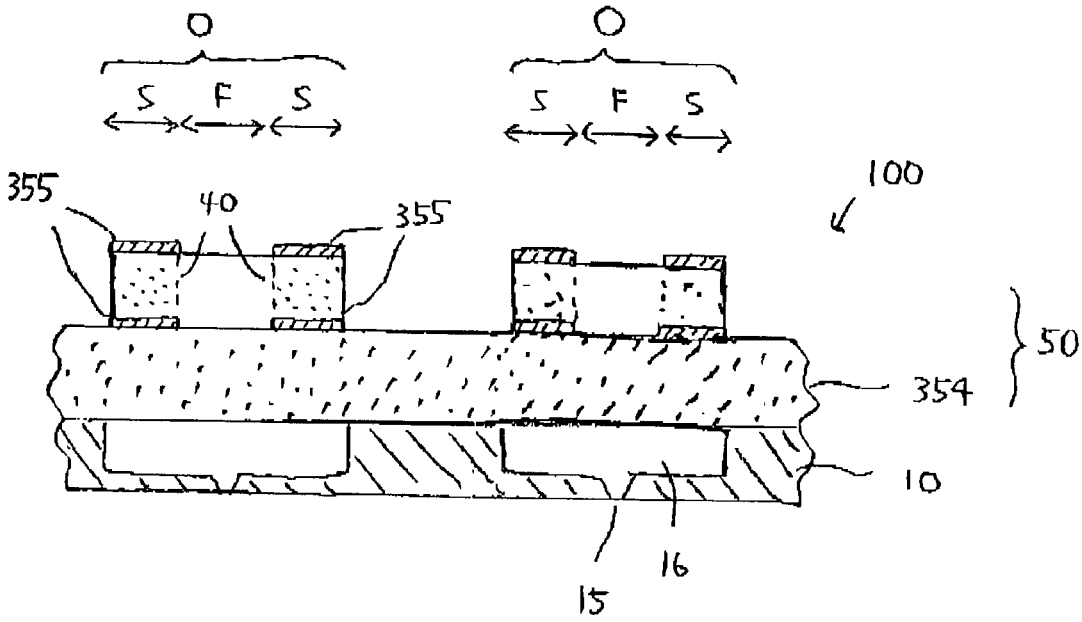
FIG. 27(B) is a partial cross-sectional view that corresponds to FIG. 7, illustrating an ink jet head having an piezoelectric actuator according to another modification.

Similarly, in the above-described modification of FIG. 26(B), the plurality of operation portions O are formed in the single piezoelectric layer 352. However, as shown in FIG. 27(B), a plurality of operation portions O, each being made of piezoelectric material, may be formed individually from one another. The plurality of piezoelectric operation portions O are arranged in the planar direction over the ceramic or resin layer 354 separately from one another in the planar direction. The pair of electrodes 355 are provided to sandwich therebetween each second portion S in each operation portion O to provide the active portion 40. The cavity plate 10 is attached to the ceramic or resin layer 354 side, but may be attached to the upper sides of the plurality of piezoelectric operation portions O.

The number of the electrodes 24, 25 provided in the actuator 50 is not limited to those described above.

What is claimed is:

1. A piezoelectric actuator comprising:

a plate including:

first and second surfaces that are separated from each other by a predetermined distance in a thickness direction and that extend in a predetermined planar direction substantially perpendicular to the thickness direction; and an operation portion having:

a first portion; and a pair of second portions disposed symmetrically on either side of the first portion with respect to the planar direction; and at least one electrode located in each second portion, the at least one electrode including at least one pair of electrodes so as to sandwich an active portion, the active portion being defined in each second portion between the pair of electrodes and located nearer to the first surface than the second surface in the thickness direction, at least the active portion in the plate being formed from piezoelectric material, the at least one pair of electrodes generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction.

2. A piezoelectric actuator as claimed in claim 1, wherein the pair of electrodes in each second portion are disposed in confrontation with each other so as to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing the length of the active portion in the planar direction, thereby bending the corresponding second portion in a direction from one to the other of the first surface and the second surface, and consequently bending the first portion in an opposite direction from the other to the one of the first surface and the second surface, thereby deforming the operation portion in the thickness direction.

3. A piezoelectric actuator as claimed in claim 2, wherein the pair of electrodes are disposed in confrontation with each other so as to sandwich the active portion therebetween in the planar direction, the active portion being polarized in the planar direction, the electric field generated between the confronting electrodes changing the length of the active portion in the planar direction.

4. A piezoelectric actuator as claimed in claim 2, wherein the pair of electrodes are disposed in confrontation with each other so as to sandwich the active portion therebetween in the thickness direction, the active portion being polarized in the thickness direction, the electric field generated between the confronting electrodes changing the length of the active portion in the planar direction.

5. A piezoelectric actuator as claimed in claim 4, wherein the pair of electrodes include a plurality of pairs of electrodes aligned in the thickness direction in each second portion, a plurality of active portions being defined between the plurality of pairs of electrodes in each second portion and being positioned nearer to the first surface than the second surface in the thickness direction.

6. A piezoelectric actuator as claimed in claim 4, wherein the pair of electrodes include at least a first electrode and a second electrode, the first and second electrodes being located with the first surface being closer to the first electrode than to the second electrode in the thickness direction, the first electrode having a surface area in the planar direction that is equal to or greater than surface area of the second electrode in the planar direction.

7. A piezoelectric actuator as claimed in claim 2, wherein the plate is formed from a plurality of sheets of piezoelectric material, the sheets of piezoelectric material being stacked in the thickness direction, the pair of electrodes including a plurality of pairs of electrodes interposed between the sheets of piezoelectric material.

8. A piezoelectric actuator as claimed in claim 2, further comprising at least another pair of electrodes located in the first portion, another active portion, defined in the first portion between the other pair of electrodes, being located nearer to the second surface than the first surface in the thickness direction, at least the other active portion in the plate being formed from piezoelectric material, the other pair of electrodes generating an electric field for deforming the other active portion in the planar direction, thereby bending the first portion in the direction from the other to the one of the first surface and the second surface.

9. A piezoelectric actuator as claimed in claim 8, wherein the operation portion further includes an inactive portion located in each second portion, the inactive portion being positioned nearer to the second surface than the first surface in the thickness direction, wherein the pair of electrodes generate an electric field for changing the length of the active portion in the planar direction, thereby archingly deforming the pair of second portions in a direction from one to the other of the first surface and the second surface, wherein the operation portion further includes another inactive portion located in the first portion at a position nearer to the first surface than to the second surface in the thickness direction, and wherein the other pair of electrodes generate an electric field for changing the length of the other active portion in the planar direction while the length of the other inactive portion is maintained in the planar direction, thereby archingly deforming the first portion in the direction from the other to the one of the first surface and the second surface.

10. A piezoelectric actuator as claimed in claim 8, wherein the pair of electrodes generate an electric field for contracting the active portion of the plate in the planar direction, thereby deforming the pair of second portions to protrude in a direction from the first surface to the second surface, and wherein the other pair of electrodes generate an electric field for contracting the other active portion of the plate in the planar direction, thereby deforming the first portion to protrude in the opposite direction from the second surface to the first surface.

11. A piezoelectric actuator as claimed in claim 8, wherein the pair of electrodes generate an electric field for extending the active portion of the plate in the planar direction, thereby deforming the pair of second portions to protrude in a direction from the second surface to the first surface, wherein the other pair of electrodes generate an electric field for extending the other active portion of the plate in the planar direction, thereby archingly deforming the first portion to protrude in the opposite direction from the first surface to the second surface.

12. A piezoelectric actuator as claimed in claim 8, wherein one of the pair of electrodes and the one of the other pair of electrodes are integrated together into a common electrode that spans across the first portion and the second portion, wherein the other one of the electrode pair is disposed in each second portion in confrontation with a part of the common electrode that resides in the second portion so as to sandwich the active portion therebetween in the thickness direction, the active portion being polarized in the thickness direction, the electric field generated between the confronting electrodes deforming the active portion in the planar direction, and wherein the other one of the other electrode pair is disposed in the first portion in confrontation with a remaining part of the common electrode that resides in the first portion so as to sandwich the other active portion therebetween in the thickness direction, the other active portion being polarized in the thickness direction, the electric field generated between the confronting electrodes deforming the other active portion in the planar direction.

13. A piezoelectric actuator as claimed in claim 8, wherein the pair of electrodes are disposed in confrontation with each other so as to sandwich the active portion therebetween in the planar direction, the active portion being polarized in the planar direction, the electric field generated between the confronting electrodes changing the length of the active portion in the planar direction, and wherein the other pair of electrodes are disposed in confrontation with each other so as to sandwich the other active portion therebetween in the planar direction, the other active portion being polarized in the planar direction, the electric field generated between the confronting electrodes changing the length of the other active portion in the planar direction.

14. A piezoelectric actuator as claimed in claim 8, wherein the pair of electrodes are disposed in confrontation with each other so as to sandwich the active portion therebetween in the thickness direction, the active portion being polarized in the thickness direction, the electric field generated between the confronting electrodes extending the active portion in the planar direction, and wherein the other pair of electrodes are disposed in confrontation with each other so as to sandwich the other active portion therebetween in the thickness direction, the other active portion being polarized in the thickness direction, the electric field generated between the confronting electrodes extending the other active portion in the planar direction.

15. A piezoelectric actuator as claimed in claim 8, further comprising:

a fluid accommodating plate disposed so as to face one of the first surface and the second surface of the plate, the fluid accommodating plate being formed with a fluid accommodating chamber, the operation portion of the plate confronting the fluid accommodating chamber, volume of the fluid accommodation chamber changing in association with the deformation of the first portion and of the pair of second portions to transport fluid of the fluid accommodation chamber; and a hole-defining portion defining an ejection hole in fluid communication with the fluid accommodation chamber, change in volume of the fluid accommodation chamber transporting the fluid in the fluid accommodation chamber through the ejection hole.

16. A piezoelectric actuator as claimed in claim 15, wherein the fluid accommodation plate is positioned in confrontation with the second surface of the plate, the pair of electrodes generating an electric field to archingly deform the pair of second portions in a direction from the first surface to the second surface, the other pair of electrodes generating an electric field to archingly deform the first portion in an opposite direction from the second surface to the first surface to thereby increase volume in the fluid accommodation chamber, the pair of electrodes and the other pair of electrodes then stopping generation of the electric field so as to let the pair of second portions and the first portion to recover their original states to thereby reduce volume in the fluid accommodation chamber and eject fluid from the ejection hole.

17. A piezoelectric actuator as claimed in claim 16, wherein the pair of electrodes generate an electric field for contracting the active portion of the plate in the planar direction, thereby deforming the pair of second portions to protrude in a direction from the first surface to the second surface, and wherein the other pair of electrodes generate an electric field for contracting the other active portion of the plate in the planar direction, thereby deforming the first portion to protrude in the opposite direction from the second surface to the first surface.

18. A piezoelectric actuator as claimed in claim 15, wherein the fluid accommodation plate is positioned in confrontation with the first surface of the plate, the pair of electrodes generating an electric field to archingly deform the pair of second portions in a direction from the first surface to the second surface, the other pair of electrodes generating an electric field to archingly deform the first portion in an opposite direction from the second surface to the first surface to thereby reduce volume in the fluid accommodation chamber and eject fluid from the ejection hole.

19. A piezoelectric actuator as claimed in claim 18, wherein the pair of electrodes generate an electric field for contracting the active portion of the plate in the planar direction, thereby deforming the pair of second portions to protrude in a direction from the first surface to the second surface, and wherein the other pair of electrodes generate an electric field for contracting the other active portion of the plate in the planar direction, thereby deforming the first portion to protrude in the opposite direction from the second surface to the first surface.

20. A piezoelectric actuator as claimed in claim 2, wherein the plate includes:

a piezoelectric layer defining the first surface and formed from piezoelectric material, the pair of electrodes being provided to the piezoelectric layer to define the active portion therebetween in the piezoelectric layer; and an additional layer defining the second surface and formed from material other than the piezoelectric material.

21. A piezoelectric actuator as claimed in claim 20, wherein the additional layer is formed from either one of ceramic and resin, and wherein the pair of electrodes are located in each second portion to sandwich the piezoelectric layer therebetween, the pair of electrodes generating an electric field for deforming the active portion in the planar direction.

22. A piezoelectric actuator as claimed in claim 2, wherein the plate includes a piezoelectric layer defining the first surface and formed from piezoelectric material, the pair of electrodes being provided to sandwich the piezoelectric layer therebetween to define the active portion therebetween in the piezoelectric layer, wherein the pair of electrodes in each second portion includes a first side electrode and a second side electrode, the first side electrode being located on the first surface, the second side electrodes in the pair of electrodes in the pair of second portions being integrated together into a metal layer formed from metal, the metal layer defining the second surface at its side opposite to a side at which the metal layer faces the piezoelectric layer, and wherein the active portion is defined in each second portion at a location between the first side electrode and the second side electrode, the first side electrode and the second side electrode generating the electric field for deforming the active portion in the planar direction.

23. A piezoelectric actuator as claimed in claim 2, wherein the plate includes a plurality of operation portions made of a plurality of piezoelectric material portions, the plurality of piezoelectric material portions being arranged in the planar direction separately from one another in the planar direction, the plurality of piezoelectric material portions defining the first surface, wherein the plate further includes an additional layer defining the second surface and formed from material other than the piezoelectric material.

24. A piezoelectric actuator as claimed in claim 23, wherein the additional layer is formed from either one of ceramic and resin.

25. A piezoelectric actuator as claimed in claimed 2, wherein the plate includes a plurality of operation portions made of a plurality of piezoelectric material portions, the plurality of piezoelectric material portions being arranged in the planar direction separately from one another in the planar direction, the plurality of piezoelectric material portions defining the first surface, wherein the pair of electrodes in each second portion includes a first side electrode and a second side electrode, the first side electrode being located on the first surface, the second side electrodes in the pair of electrodes in the pair of second portions being integrated together into a metal layer formed from metal, the metal layer defining the second surface at its side opposite to a side at which the metal layer faces the plurality of piezoelectric material portions, and wherein the active portion is defined in each second portion at a location between the first side electrode and the second side electrode, the first side electrode and the second side electrode generating the electric field for deforming the active portion in the planar direction.

26. A piezoelectric actuator as claimed in claim 1, wherein the operation portion further includes an inactive portion located in each second portion, the inactive portion being positioned nearer to the second surface than the first surface in the thickness direction, and wherein the electrode generates an electric field for changing the length of the active portion in the planar direction, while maintaining the length of the inactive portion to be unchanged, thereby archingly deforming the pair of second portions in a direction from one to the other of the first surface and the second surface, and consequently archingly deforming the first portion in the opposite direction from the other to the one of the first surface and the second surface.

27. A piezoelectric actuator as claimed in claim 1, wherein the electrode generates an electric field for contracting the active portion of the plate in the planar direction, thereby deforming the pair of second portions to protrude in a direction from the first surface to the second surface, and consequently archingly deforming the first portion to protrude in the opposite direction from the second surface to the first surface.

28. A piezoelectric actuator as claimed in claim 1, wherein the electrode generates an electric field for extending the active portion of the plate in the planar direction, thereby deforming the pair of second portions to protrude in a direction from the second surface to the first surface, and consequently archingly deforming the first portion to protrude in the opposite direction from the first surface to the second surface.

29. A piezoelectric actuator as claimed in claim 1, further comprising a fixed member fixed to one of the first and second surfaces of the plate and being positioned closer to one of the pair of second portions than to the first portion.

30. A piezoelectric actuator as claimed in claim 1, wherein the first portion of the plate has a configuration that deforms more easily than the second portion.

31. A piezoelectric actuator as claimed in claim 30, wherein the first portion includes a notch at a position nearer to the first surface than to the second surface in the thickness direction.

32. A piezoelectric actuator as claimed in claim 31, wherein the notch is opened at the first surface of the plate, a connection electrode for supplying power to the electrode being provided in the notch.

33. A piezoelectric actuator as claimed in claim 1, further comprising a fluid accommodating plate disposed so as to face one of the first surface and the second surface of the plate, the fluid accommodating plate being formed with a fluid accommodating chamber, the operation portion of the plate confronting the fluid accommodating chamber, volume of the fluid accommodation chamber changing in association with the deformation of the first portion and of the pair of second portions to transport fluid of the fluid accommodation chamber.

34. A piezoelectric actuator as claimed in claim 33, wherein:

the fluid accommodation plate includes a plurality of fluid accommodation chambers, the fluid accommodation chambers being juxtaposed in a planar condition; and the plate includes a plurality of operation portions juxtaposed in the planar direction in one-to-one correspondence with the fluid accommodation chambers of the fluid accommodation plate.

35. A piezoelectric actuator as claimed in claim 34, wherein the fluid accommodation plate includes a plurality of partition walls each for separating a corresponding fluid accommodation chamber from its adjacent fluid accommodation chamber, one of the first and second surfaces of the plate being connected to each partition wall, and each partition wall being positioned closer to the corresponding second portions than to the corresponding first portions.

36. A piezoelectric actuator as claimed in claim 33, further comprising a hole-defining portion defining an ejection hole in fluid communication with the fluid accommodation chamber, change in volume of the fluid accommodation chamber transporting the fluid in the fluid accommodation chamber through the ejection hole.

37. A piezoelectric actuator as claimed in claim 36, wherein the fluid accommodation plate includes the hole-defining portion, the ejection hole defined by the hole-defining portion being in fluid communication with the fluid accommodation chamber to eject the fluid.

38. A piezoelectric actuator as claimed in claim 36, wherein the plate includes the hole-defining portion, the ejection hole defined by the hole-defining portion being opened through the thickness of the plate in fluid communication with the fluid accommodation chamber.

39. A piezoelectric actuator as claimed in claim 36, wherein the fluid accommodation plate is positioned in confrontation with the second surface of the plate, the electrode generating an electric field to archingly deform the pair of second portions in a direction from the first surface to the second surface, and consequentially archingly deforming the first portion in an opposite direction from the second surface to the first surface to thereby increase volume in the fluid accommodation chamber, the electrode then stopping generation of the electric field so as to let the pair of second portions and the first portion to recover their original states to thereby reduce volume in the fluid accommodation chamber and eject fluid from the ejection hole.

40. A piezoelectric actuator an claimed in claim 39, wherein the electrode generates the electric field for contracting the active portion of the plate in the planar direction, thereby deforming the pair of second portions to protrude in a direction from the first surface to the second surface, and consequently archingly deforming the first portion to protrude in the opposite direction from the second surface to the first surface.

41. A piezoelectric actuator as claimed in claim 36, wherein the fluid accommodation plate is positioned in confrontation with the first surface of the plate, the electrode generating an electric field to archingly deform the pair of second portions in a direction from the second surface to the first surface, and consequentially archingly deforming the first portion in an opposite direction from the first surface to the second surface to thereby increase volume in the fluid accommodation chamber, the electrode then stopping generation of the electric field so as to let the pair of second portions and the first portion to recover their original states to thereby reduce volume in the fluid accommodation chamber and eject fluid from the ejection hole.

42. A piezoelectric actuator as claimed in claim 41, wherein the electrode generates the electric field for extending the active portion of the plate in the planar direction, thereby deforming the pair of second portions to protrude in a direction from the second surface to the first surface, and consequently archingly deforming the first portion to protrude in the opposite direction from the first surface to the second surface.

43. A piezoelectric actuator as claimed in claim 1, wherein the plate further includes:

a piezoelectric layer defining the first surface and formed from piezoelectric material, the electrode being provided to the piezoelectric layer to define the active portion in the piezoelectric layer; and an additional layer defining the second surface and formed from material other than the piezoelectric material.

44. A piezoelectric actuator as claimed in claim 43, wherein the additional layer is formed from either one of ceramic and resin, and wherein the pair of electrodes are located in each second portion to sandwich the piezoelectric layer therebetween.

45. A piezoelectric actuator as claimed in claim 1, wherein the plate includes a plurality of operation portions made of a plurality of piezoelectric material portions, the plurality of piezoelectric material portions being arranged in the planar direction separately from one another in the planar direction, the plurality of piezoelectric material portions defining the first surface, wherein the plate further includes an additional layer defining the second surface and formed from material other than the piezoelectric material.

46. A piezoelectric actuator as claimed in claim 1, wherein the plate is formed of piezoelectric material.

47. A fluid transporting device, comprising:

a plate including:

first and second surfaces that are separated from each other by a predetermined distance in a thickness direction and that extend in a predetermined planar direction substantially perpendicular to the thickness direction; and an operation portion having:

a first portion; and a pair of second portions disposed symmetrically on either side of the first portion with respect to the planar direction;

at least one electrode located in each second portion, the at least one electrode including at least one pair of electrodes so as to sandwich an active portion, the active portion being defined in each second portion between the pair of electrodes and located nearer to the first surface than the second surface in the thickness direction, at least the active portion in the plate being formed from piezoelectric material, the at least one pair of electrodes generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction;

a fluid accommodating plate disposed so as to face one of the first surface and the second surface of the plate, the fluid accommodating plate being formed with a fluid accommodating chamber, the operation portion of the plate confronting the fluid accommodating chamber, volume of the fluid accommodation chamber changing in association with the deformation of the first portion and of the pair of second portions to transport fluid of the fluid accommodation chamber; and a hole-defining portion defining an ejection hole in fluid communication with the fluid accommodation chamber, change in volume of the fluid accommodation chamber transporting the fluid in the fluid accommodation chamber through the ejection hole.

48. A fluid transporting device as claimed in claim 47, wherein the pair of electrodes in each second portion are disposed in confrontation with each other so as to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing the length of the active portion in the planar direction, thereby bending the corresponding second portion in a direction from one to the other of the first surface and the second surface, and consequently bending the first portion in an opposite direction from the other to the one of the first surface and the second surface, thereby deforming the operation portion in the thickness direction.

49. A fluid transporting device as claimed in claim 48, wherein the operation portion further includes an inactive portion located in each second portion, the inactive portion being positioned nearer to the second surface than the first surface in the thickness direction, and wherein the electrode generates an electric field for changing the length of the active portion in the planar direction, while maintaining the length of the inactive portion to be unchanged, thereby archingly deforming the pair of second portions in a direction from one to the other of the first surface and the second surface, and consequently archingly deforming the first portion in an opposite direction from the other to the one of the first surface and the second surface.

50. An ink transporting device, comprising:

a plate including:

first and second surfaces that are separated from each other by a predetermined distance in a thickness direction and that extend in a predetermined planar direction substantially perpendicular to the thickness direction; and an operation portion having:

a first portion; and a pair of second portions disposed symmetrically on either side of the first portion with respect to the planar direction;

at least one electrode located in each second portion, the at least one electrode including at least one pair of electrodes so as to sandwich an active portion, the active portion being defined in each second portion between the pair of electrodes and located nearer to the first surface than the second surface in the thickness direction, at least the active portion in the plate being formed from piezoelectric material, the at least one pair of electrodes generating an electric field for deforming the active portion in the planar direction, thereby bending each second portion in a direction from one to the other of the first surface and the second surface, and consequently bending the first portion in an opposite direction from the other to the one of the first surface and the second surface, thereby deforming the operation portion in the thickness direction;

a ink accommodating plate disposed so as to face one of the first surface and the second surface of the plate, the ink accommodating plate being formed with an ink accommodating chamber, the operation portion of the plate confronting the ink accommodating chamber, volume of the ink accommodation chamber changing in association with the deformation of the first portion and of the pair of second portions to transport ink of the ink accommodation chamber; and a hole-defining portion defining an ejection hole in ink communication with the ink accommodation chamber, change in volume of the ink accommodation chamber transporting the ink in the ink accommodation chamber through the ejection hole.

51. An ink transporting device as claimed in claim 50, wherein the pair of electrodes in each second portion are disposed in confrontation with each other so as to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing the length of the active portion in the planar direction, thereby bending the corresponding second portion in a direction from one to the other of the first surface and the second surface, and consequently bending the first portion in an opposite direction from the other to the one of the first surface and the second surface, thereby deforming the operation portion in the thickness direction.

52. An ink transporting device as claimed in claim 51, wherein the operation portion further includes an inactive portion located in each second portion, the inactive portion being positioned nearer to the second surface than the first surface in the thickness direction, and wherein the electrode generates an electric field for changing the length of the active portion in the planar direction, while maintaining the length of the inactive portion to be unchanged, thereby archingly deforming the pair of second portions in a direction from one to the other of the first surface and the second surface, and consequently archingly deforming the first portion in an opposite direction from the other to the one of the first surface and the second surface.

* * * * *